US009033329B2

(12) United States Patent
Fustinoni et al.

(10) Patent No.: US 9,033,329 B2
(45) Date of Patent: May 19, 2015

(54) MULTI-FUNCTION BINDING MACHINE

(75) Inventors: Roberto Fustinoni, Palazzolo S/O (IT); Giuseppe Andreoni, Azzano San Paolo (IT)

(73) Assignee: Meccanotecnica S.P.A. (IT)

( * ) Notice: Subject to any disclaimer, the term of this patent is extended or adjusted under 35 U.S.C. 154(b) by 247 days.

(21) Appl. No.: 13/383,757

(22) PCT Filed: Sep. 2, 2011

(86) PCT No.: PCT/EP2011/065224

§ 371 (c)(1),
(2), (4) Date: Mar. 9, 2012

(87) PCT Pub. No.: WO2012/028725

PCT Pub. Date: Mar. 8, 2012

(65) Prior Publication Data

US 2013/0058739 A1 Mar. 7, 2013

(30) Foreign Application Priority Data

Sep. 3, 2010 (IT) ..... MI2010A1605
May 24, 2011 (IT) ..... MI2011A0935

(51) Int. Cl.

| | |
|---|---|
| ***B42C 1/12*** | (2006.01) |
| ***B65H 39/02*** | (2006.01) |
| *B42B 2/02* | (2006.01) |
| *B42B 9/04* | (2006.01) |
| *B42C 19/02* | (2006.01) |
| *B42C 19/04* | (2006.01) |

(52) U.S. Cl.

CPC ... *B42C 1/12* (2013.01); *B42B 2/02* (2013.01); *B42B 9/04* (2013.01); *B42C 19/02* (2013.01); *B42C 19/04* (2013.01); *B42P 2261/04* (2013.01); *B65H 39/02* (2013.01); *B65H 2301/4351* (2013.01); *B65H 2511/52* (2013.01)

(58) Field of Classification Search

USPC ..... 270/52.26, 52.27, 52.28, 52.29, 58.02, 270/58.03

See application file for complete search history.

(56) References Cited

U.S. PATENT DOCUMENTS

| | | | | |
|---|---|---|---|---|
| 3,317,026 | A * | 5/1967 | Zugel et al. | 198/341.04 |
| 4,022,455 | A * | 5/1977 | Newsome et al. | 270/52.29 |
| 4,121,818 | A * | 10/1978 | Riley et al. | 270/52.29 |
| 4,198,039 | A * | 4/1980 | Bryson et al. | 270/52.29 |
| 4,519,599 | A * | 5/1985 | Mayer | 270/52.18 |
| 4,799,661 | A * | 1/1989 | Nail | 270/52.04 |
| 4,989,850 | A * | 2/1991 | Weller | 270/1.02 |
| 5,144,562 | A * | 9/1992 | Stikkelorum et al. | 700/223 |

(Continued)

FOREIGN PATENT DOCUMENTS

| | | |
|---|---|---|
| CH | 504976 | 3/1971 |
| CN | 201313447 Y | 9/2009 |
| EP | 0997421 | 5/2000 |
| EP | 0846573 | 3/2002 |

(Continued)

*Primary Examiner* — Patrick Mackey
(74) *Attorney, Agent, or Firm* — Janeway Patent Law PLLC

(57) ABSTRACT

A multi-function binding machine is proposed. The multi-function binding machine (700) comprises a binding station (135) for binding blocks of signatures (105), and a feeding station (115) for receiving signatures in succession, opening the signatures, and feeding the signatures to the binding station; in the solution according to an embodiment of the invention, the multi-function binding machine further comprises a further feeding station (715) for receiving pre-signatures in successions, folding groups of at least one pre-signature into further signatures (729), and feeding the further signatures to the binding station.

44 Claims, 15 Drawing Sheets

(56) References Cited

U.S. PATENT DOCUMENTS

| | | | | |
|---|---|---|---|---|
| 5,499,803 | A * | 3/1996 | Farr | 270/52.14 |
| 5,777,443 | A * | 7/1998 | Chang | 318/35 |
| 5,874,812 | A * | 2/1999 | Chang | 318/35 |
| 2003/0112479 | A1 | 6/2003 | Huber | |
| 2004/0173958 | A1 | 9/2004 | Graushar | |
| 2010/0156019 | A1* | 6/2010 | Voorhees et al. | 270/1.02 |

FOREIGN PATENT DOCUMENTS

| | | |
|---|---|---|
| EP | 1334938 | 8/2003 |
| EP | 1197456 | 7/2004 |
| EP | 1598210 | 11/2005 |
| EP | 1837197 | 9/2007 |
| EP | 1477322 | 4/2008 |
| EP | 2189293 | 5/2010 |
| EP | 2213468 A1 | 8/2010 |

* cited by examiner

MULTI-FUNCTION BINDING MACHINE

TECHNICAL FIELD

The solution according to one or more embodiments of the present invention relates to the bookbinding field. More specifically, this solution relates to bookbinding binding machines.

BACKGROUND ART

Bookbinding binding machines are commonly used to make books starting from corresponding blocks of signatures (each one of them being formed by folding a printed sheet one or more times for defining corresponding pages of the books). Particularly, in the case of bookbinding sewing machines (or simply sewing machines), the signatures are fed in succession to a sewing station, which sews each signature to the preceding ones of a corresponding book block by means of continuous threads. Typically, the sewing station comprises a movable saddle, which individually receives the signatures when in an open position (moved away from a sewing head being formed by a bank of needles and crochets); the movable saddle is then closed for transporting the signature to the sewing head.

Historically, the sewing machine was born as a stand-alone component, with manual feeding of the signatures (i.e., wherein the signatures were deposited onto the movable saddle by an operator). Later on, a transport system has been connected to the sewing machine for facilitating its feeding (being always manual); typically, the transport system was formed by a fixed saddle; the signatures were manually deposited astride the fixed saddle, which transported them in succession to the sewing station, so that each signature was individually thrown onto the movable saddle (being aligned with the fixed saddle when in the open position). Afterwards, a feeding system has been connected to the sewing machine for automating its feeding; the feeding system extracted the signatures in succession from a hopper, opened them in the middle (separating, by means of suckers, its layers each one defined by a fold of the corresponding sheet), and deposited them astride the fixed saddle. Both the transport system and the feeding system were lacking their own motor, and they were connected mechanically to the sewing machine (being provided with its own motor); the transport system and the feeding system were then driven by the same motor of the sewing machine, so as to work synchronously with the sewing machine (i.e., with its sewing station). More recently; the transport system and the feeding system have been integrated into the sewing machine (in corresponding transport station and feeding station, respective); the transport station and the feeding station have continued to be connected mechanically in a fixed way to the motor of the sewing machine, so as to work always synchronously with the sewing station.

A problem of the known sewing machines is the difficulty of sewing signatures being small (i.e., formed by few pages—for example, 4-8 pages per signature) and/or light (i.e., formed by sheets of thin paper—for example, with a weight in grams of 30-60 g/m$^2$). Indeed, in this case the threads may tear the signatures around corresponding holes being made in the signatures for their sewing. Particularly, the drawback pointed out above occurs rather commonly in case the sheets of the signatures are printed with digital printers—instead of offset printers. Indeed, the digital printers (although more versatile than the offset printers, since they allow varying the pages of the signatures in a simple and fast way without the need of creating any printing plate) are not normally capable of printing sheets of very large size, so that the corresponding signatures have a limited number of pages.

In order to overcome such drawback, small and/or light signatures are normally sewn with threads being less tight; however, this impairs the compactness and the integrity of the book block during the next processing phases (causing the production of books being defective or in any case of lower quality). Moreover, it is possible to use a stagger stitch sewing technique (wherein each needle alternatively cooperates with a next crochet and with a preceding crochet), so as to distribute the threads in a more uniform way along the signatures. However, the stagger stitch sewing technique is relatively complicated and it requires a more complex structure of the sewing head (for transporting each thread from the corresponding needle alternatively to the two adjacent crochets); moreover, this does not allow obtaining satisfactory results all the same in case of signatures formed by very few sheets (and in particular by single sheets being folded only once to define 4 pages—in jargon, a four-page signature) and/or with very thin paper.

Alternatively, it is also possible to provide composite (in jargon, overlapped) signatures to the sewing machine; each overlapped signature is formed by more signatures being simply overlapped one to another (so as to make it stronger). However, the formation of the overlapped signatures is more complex (since it requires additional operations after the folding). Moreover, the opening of each overlapped signature in the sewing machine is problematic, because of its high number of layers to be separated; indeed, the suckers commonly used for this purpose may be insufficient to reach the middle thereof. In such case, it is necessary to form the overlapped signature with a projecting lap, and to provide the sewing machine with a blade that intercepts such lap for opening the overlapped signature. However, this requires non-standard folding operations and complicates the structure of the sewing machine.

Recently, sewing machines have also been proposed that implement both the formation of the signatures and their sewing in a single passage. Particularly, each one of these sewing machines (indicated as combined sewing machines to distinguish them from the above-described sewing machines, indicated as traditional sewing machines) is provided with a gathering device that extracts flat sheets in succession from a hopper, and stacks them for forming groups of sheets corresponding to the signatures; as soon as each group of sheets is completed, it is transferred to a folding device, which folds it so as to obtain the corresponding signature. Each signature thus obtained is then deposited astride the fixed saddle, in order to be transported to the sewing station as usual. In this case, the gathering device and the folding device are driven independently of the transport station and the sewing station (instead always connected between them mechanically in fixed way). An example of combined sewing machine is described in EP-A-0846573 (the entire disclosure if which is herein incorporated by reference), while an example of combined sewing machine being available on the market is KRISTEC by Meccanotecnica S.p.A. (KRISTEC is a registered trademark of Meccanotecnica S.p.A in some countries).

The combined sewing machines allow producing books on request in a very simple way; therefore, they lend themselves particularly to be used for the production of books of limited edition, even of a few units (especially in case the corresponding sheets are provided by digital printers). However, the signatures formed in the combined sewing machines only have a few folds (generally, a single one). Therefore, in case of signatures formed be few sheets (especially if made of thin paper) they suffer the same drawbacks pointed out above for the traditional sewing machines. On the contrary, the formation of signatures of many sheets makes the combined sewing machines very slow (since they require collecting all the sheets of each signature in succession before its folding).

SUMMARY

One or more aspects of the solution according to specific embodiments of the invention are set out in the independent claims, with advantageous features of the same solution that are set out in the dependent claims, whose wording is herein incorporated verbatim by reference (with any advantageous feature provided with reference to a specific aspect of the solution according to an embodiment of the invention that applies maxis mutandis to every other aspect thereof).

More specifically, an aspect of the solution according to an embodiment of the invention provides a multi-function binding machine (for example, a multi-function sewing machine). The multi-function binding machine comprises a binding station for binding blocks of signatures (for example, a sewing station for sewing them); the multi-function binding machine is provided with a feeding station for receiving signatures in succession (for example, extracted from the bottom of a stack), opening the signatures, and feeding the signatures to the binding station (for example, through a transport station based on a fixed saddle). In the solution according to an embodiment of the invention, the multi-function binding machine comprise a further feeding station for receiving pre-signatures in successions (for example, consisting of flat sheets extracted from the top of a stack), folding groups of at least one pre-signature into further signatures, and feeding the further signatures to the binding station.

Another aspect of the solution according to an embodiment of the invention provides a binding machine (for example, a sewing machine). The binding machine comprises a binding station for binding blocks of signatures (for example, a sewing station for sewing them). The binding machine is provided with a feeding station for receiving signatures in successions (for example, extracted from the bottom of a stack), opening the signatures, and feeding the signatures to the binding station (for example, through a transport station based on a fixed saddle). In the solution according to an embodiment of the invention, the binding machine further comprises binding driving means for driving the binding station and feeding driving means for driving the feeding station (for example, two corresponding motors). Control means is provided for controlling the binding driving means and the feeding driving means independently during a processing of the signatures.

Different aspects of the solution according to embodiments of the invention provide corresponding methods.

Other aspects of the solution according to embodiments of the invention provide software programs for implementing these methods.

Further aspects of the solution according to embodiments of the invention provide corresponding program products.

BRIEF DESCRIPTION OF THE DRAWINGS

The solution according to one or more embodiments of the invention, as well as further features and the advantages thereof, will be best understood with reference to the following detailed description, given purely by way of a non-restrictive indication, to be read in conjunction with the accompanying drawings (wherein, for the sake of simplicity, corresponding elements are denoted with equal or similar references and their explanation is not repeated). In this respect, it is expressly intended that the figures are not necessary drawn to scale (with some details that may be exaggerated and/or simplified) and that, unless otherwise indicated, they are merely used to conceptually illustrate the structures and procedures described herein. Particularly.

DETAILED DESCRIPTION

Figure 1:
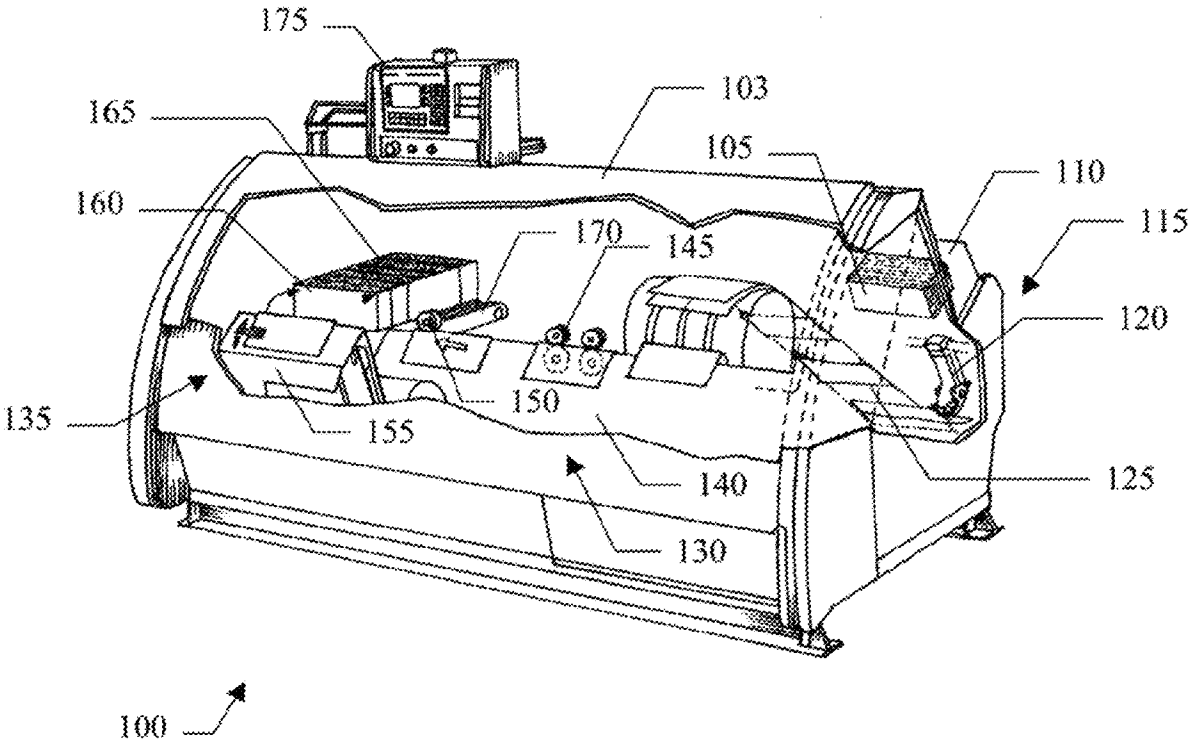
FIG. 1 shows a pictorial representation of a bookbinding sewing machine wherein the solution according to an embodiment of the invention may be applied.

With reference in particular to the FIG. 1, a pictorial representation is shown of a bookbinding sewing machine 100 wherein the solution according to an embodiment of the invention may be applied. The sewing machine 100 is used for sewing signatures 105 together for the production of corresponding sewn books (not shown in the figure). Each signature 105 is formed by a printed sheet, which is folded one or more times for defining different pages of the books.

Particularly, a hopper 110 is used for loading a stack of signatures 105 (grouped in blocks, each one for a correspondent book). The sewing machine 100 is then provided with a feeding station 115. Particularly, the feeding station 115 comprises an extraction device 120 and an opening device 125. The extraction device 120 (for example, sucker-based pliers) extracts the signatures 105 in succession from a bottom of the hopper 110, and provides them to the opening device 125; in turn, the opening device 125 (for example, based on a series of lower and upper suckers) opens each signature 105 in the middle, and feeds it to a transport station 130. The transport station 130 then transports the signatures 105 in succession to a sewing station 135. Particularly, the transport station 130 comprises a fixed saddle 140, a shaping station 145, and a throwing wheel 150. The fixed saddle 150 is formed by a saddle plate (wedge-like shaped, like an overturned V), astride of which the feeding, station 115 deposits each (opened) signature 105. A chain with pushing pegs (not shown in the figure) is housed inside the saddle plate, so that the pegs project through a longitudinal slit of the saddle plate (in correspondence to its vertex) for pushing the signatures 105 along it (across the shaping station 145 and then to the throwing wheel 150). The throwing wheel 150 accelerates each signature 105, so as to separate it from the preceding ones and through it individually towards the sewing station 135. Particularly, the sewing station 135 comprises a movable saddle 155 and a sewing head 160. The movable saddle 155 receives each signature 105 from the fixed saddle 140 (when it is open so as to be aligned therewith). The movable saddle 145 is then raised for bringing the signature 105 below the sewing head 160; the sewing head 160 sews the signature 105 being loaded on the movable saddle 155 by means of continuous threads to a current book block in the making (by joining it to a preceding signature of the book block if different from the first one). As soon as the book block is completed, the threads are cut for separating it from the next signatures. The book blocks so obtained (denoted with the reference 165) are placed in succession onto an output conveyor 170, which supplies them to further machines (not shown in the figure) that complete the corresponding books. The operation of the entire sewing machine 100 is managed by a programmable logic controller (PLC) 175. Generally, the controller 175 is provided with a control unit, a working volatile memory (or RAM), and a non-volatile memory (for example, an EEPROM) for storing programs and data; the control unit is connected in a conventional way to a control panel (for example, of touch-screen type).

Figure 2:
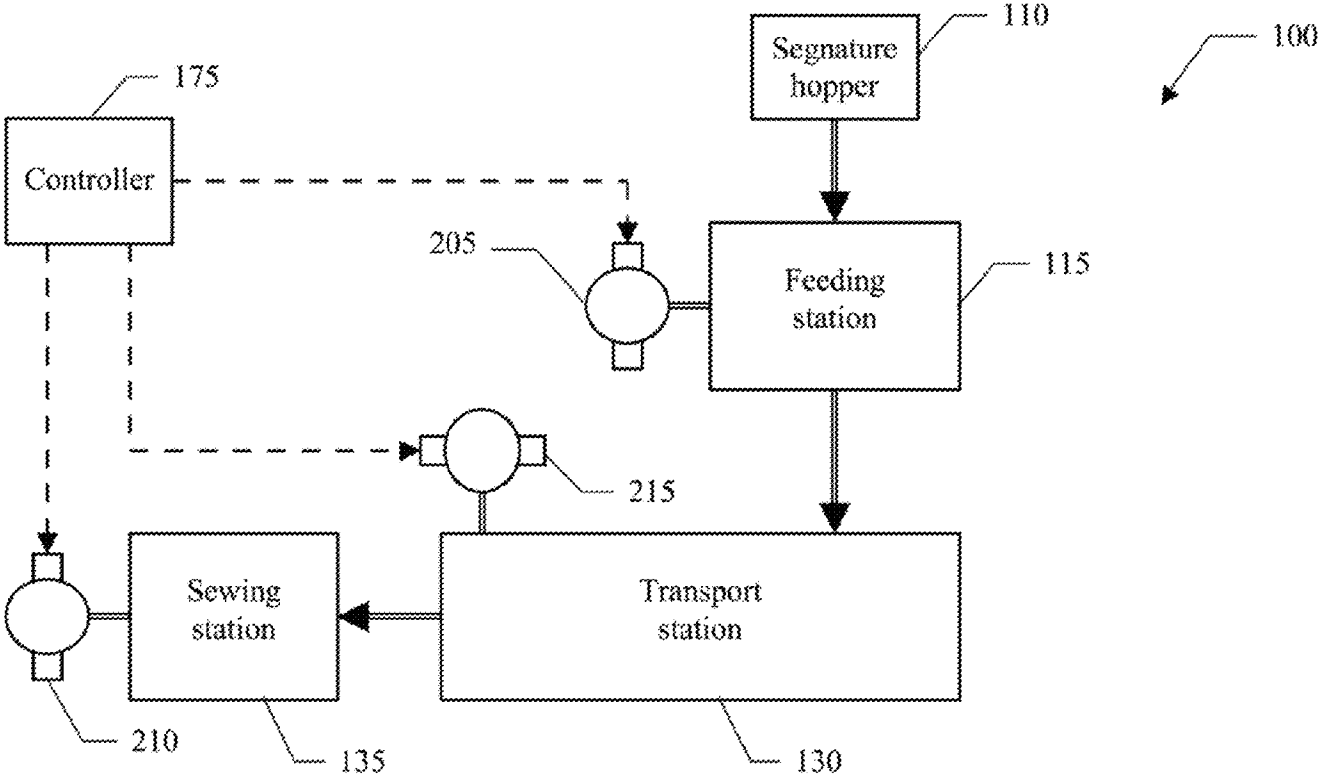
FIG. 2 shows a functional block diagram of such sewing machine according to an embodiment of the invention.

A functional block diagram of the sewing machine 100 according to an embodiment of the invention is shown in the FIG. 2. In this case, the feeding station 115 is driven independently of the sewing station 135 during a processing of the signatures.

Particularly, in a specific implementation the sewing machine 100 is provided with two distinct motors 205 and 210 (with respective control encoders or resolvers) for driving the feeding station 115 and the sewing station 135, respectively; in this case, the controller 175 controls the motors 205 and 210 independently.

As a further improvement, the transport station 130 as well is driven independently of the feeding station 115 (and then from the sewing station 135 as well) during the processing of the signatures. Particularly, in a specific implementation the sewing machine 100 is provided with a further motor 215 (with respective encoder or resolver) for driving the transport station 130; in this case, the controller 175 controls all the motors 205, 210 and 215 independently.

The above-described structure makes the sewing machine 100 very versatile; indeed, the possibility of driving the feeding station 115 and the sewing station 135 (and possibly the transport station 130 as well) independently allows stopping the corresponding stations selectively and/or operating them at different speed (during the processing of the signatures). This provides a number of advantages.

For example, in this way it is possible to stack two or more signatures onto the fixed saddle, so as to form corresponding overlapped signatures (hereinafter, the signatures that compose the overlapped signatures are indicated as simple signatures for distinguishing them therefrom). This allows sewing the signatures without any problem, even when they are small (i.e., formed by few pages) and/or light (i.e., formed by sheets of thin paper). Indeed, the overlapped signatures thus obtained are stronger, thereby reducing the risk that the threads may tear the signatures (around corresponding holes made in the signatures for their sewing). Particularly, this advantage is mostly appreciated in case the sheets of the signatures are printed with digital printers (instead of with offset printers)—even if the application of the proposed solution is not limited thereto; this allows exploiting all the advantages offered by the digital printers (i.e., their greater versatility that allows varying the pages of the signatures in a simple and fast way without the need of creating any printing plate), without suffering the drawbacks caused by the generally limited size of the sheets printed by them (which involves the creation of corresponding signatures with limited number of pages). Moreover, in this case it is also much easier modifying the printing of the simple signatures so that their pages appear in the correct order within the overlapped signatures. Generally, this allows obtaining satisfactory results (in terms of compactness and integrity of the book blocks, thus of quality of the corresponding books) even with small and/or light signatures. In this respect, it should be noted that the proposed solution allows forming the overlapped signatures directly on the fixed saddle of the sewing machine; in this way, it is possible to exploit the advantages of the overlapped signatures (i.e., greater robustness) without the corresponding drawbacks (i.e., additional operations after the folding and opening difficulty).

Different examples of application of the solution according to corresponding embodiments of the invention are shown in the FIG. 3A-FIG. 3B, FIG. 4A-FIG. 4D and FIG. 5A-FIG. 5D.

Figure 3A:
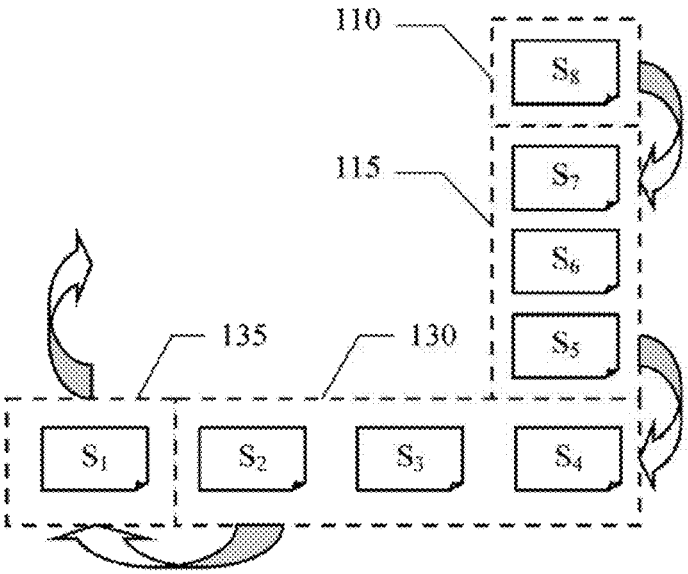
FIG. 3A-FIG. 3B show an example of application of the solution according to an embodiment of the invention.
Figure 3B:
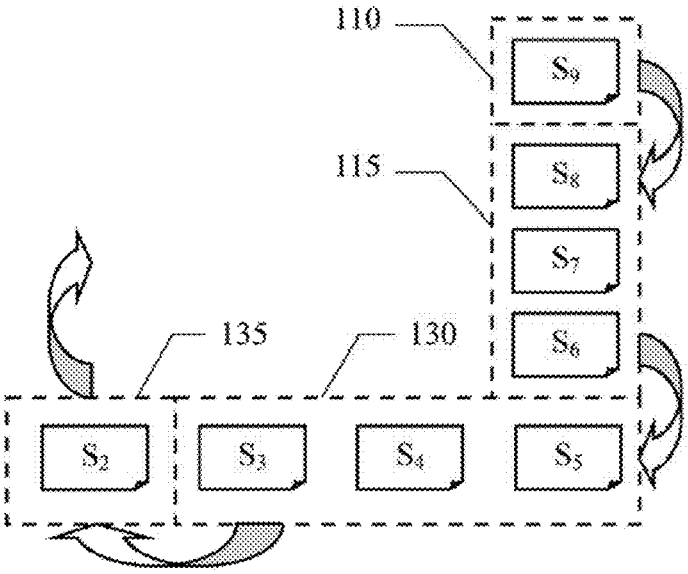

With reference in particular to the FIG. 3A-FIG. 3B, the sewing machine may be used for sewing the signatures together as usual; for this purpose, the controller of the sewing machine drives the feeding station 115, the transport station 130 and the sewing station 135 at the same operative frequency—i.e., actually creating an electrical connection among the stations 115, 130 and 135 (as it happens in the known sewing machines, wherein a single motor is provided that drives all these stations with fixed mechanical connection).

For example, the situation illustrated in the FIG. 3A is considered, wherein a signature $S_1$ is present in the sewing station 135 (loaded on its movable saddle), a series of signatures $S_2$, $S_3$ and $S_4$ is present in the transport station 130 (loaded in this order on its fixed saddle from the sewing station 135 returning back towards the feeding station 115), a series of signatures $S_5$, $S_6$ and $S_7$ is present in the feeding station 115 (loaded in this order in its opening device from the transport station 130 returning back towards the hopper 110), and a signature S8 is present at the bottom of the hopper 110 (ready to be extracted).

During an operative cycle of the sewing station 135, an operative cycle of the transport station 130, and an operative cycle of the feeding station 115 (equal one to another), as shown in the FIG. 3B together with the FIG. 3A, each one of these stations 135, 130 and 115 processes a corresponding signature. Particularly, the signature $S_1$ is sewn in the sewing station 135 to a current book block in the making, so as to release the sewing station 135 (by slipping off its mobile saddle). At the same time, the signatures $S_2$, $S_3$ and $S_4$ move forward in the transport station 130 (by a position defined by the pushing pegs of its fixed saddle), so that the signature $S_2$ is supplied to the sewing station 135 (by throwing it onto its movable saddle) and a position is released in the transport station 130 in front of the feeding station 115. Moreover, the signatures $S_5$, $S_6$ and $S_7$ move forward in the feeding station 115, so that the signature S5 is supplied to the transport station 130 (by depositing it into the free position of its fixed saddle). At the end, the signature $S_8$ passes from the hopper 110 to the feeding station 115 (collected by its extraction device), so that a further signature $S_9$ goes to the bottom of the hopper 110. The same operations described above are then repeated cyclically.

With reference instead to the FIG. 4A-FIG. 4D, the sewing machine may be used for forming and sewing together overlapped signatures; for this purpose, the controller of the sewing machine stops the transport station 130 and the sewing station 135 (which may also be driven by a single motor with fixed mechanical connection) during the formation of each overlapped signature by the feeding station 115, which is instead driven continuously as usual. In this respect, it should be noted that the fact of maintaining the sewing station 135 stopped in general does not involve any significant problems, since during every operative cycle thereof in any case there is provided a stopping period of the mobile saddle (i.e., the part thereof with the greater inertia) for receiving the signature to be sewn from the fixed saddle.

Figure 4A:
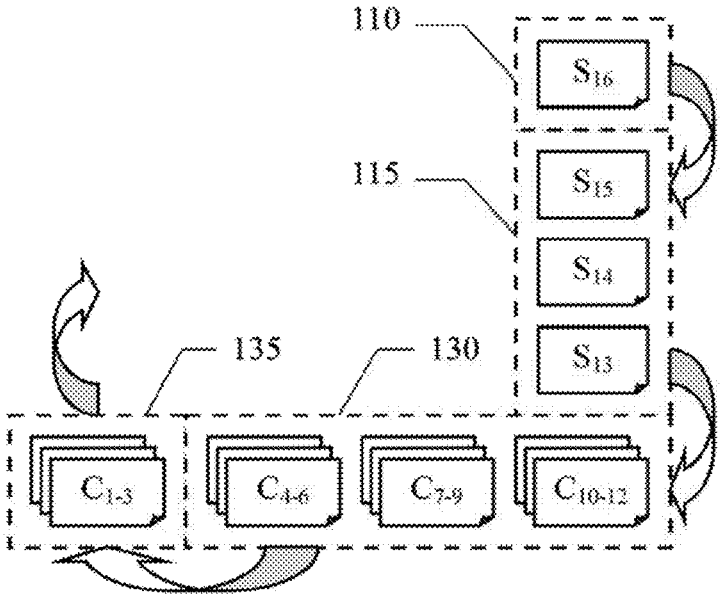
FIG. 4A-FIG. 4D show a further example of application of the solution according to an embodiment of the invention.

For example, in case of overlapped signatures each one formed by 3 simple signatures, the situation illustrated in the FIG. 4A is considered, wherein an overlapped signature $C_{1-3}$ is present in the sewing station 135, a series of overlapped signatures $C_{4-6}$, $C_{7-9}$ and $C_{10-12}$ is present in the transport station 130, a series of simple signatures $S_{13}$, $S_{14}$ and $S_{15}$ is present in the feeding station 115, and a simple signature $S_{16}$ is present at the bottom of the hopper 110.

Figure 4B:
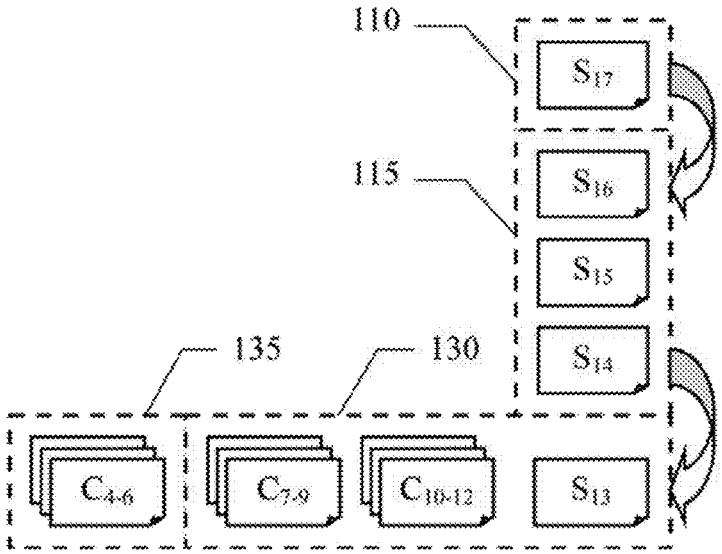

During an operative cycle of the sewing station 135, an operative cycle of the transport station 130, and an operative cycle of the feeding station 115 (equal one to another), as shown in the FIG. 4B together with the FIG. 4A, each one of these stations 135, 130 and 115 processes a corresponding (overlapped or simple) signature. Particularly, the overlapped signature $C_{1-3}$ is sewn in the sewing station 135 to a current book block in the making, so as to release the sewing station 135. At the same time, the overlapped signatures $C_{4-6}$, $C_{7-9}$ and $C_{10-12}$ move forward in the transport station 130, so that the overlapped signature $C_{4-6}$ is supplied to the sewing station 135 and a position is released in the transport station 130 in front of the feeding station 115. Moreover, the simple signatures $S_{13}$, $S_{14}$ and $S_{15}$ move forward in the feeding station 115, so that the simple signature $S_{13}$ is supplied to the transport station 130 (for starting the formation of a new overlapped signature). At the end, the signature $S_{16}$ passes from the hopper 110 to the feeding station 115, so that a further simple signature $S_{17}$ goes to the bottom of the hopper 110.

Figure 4C:
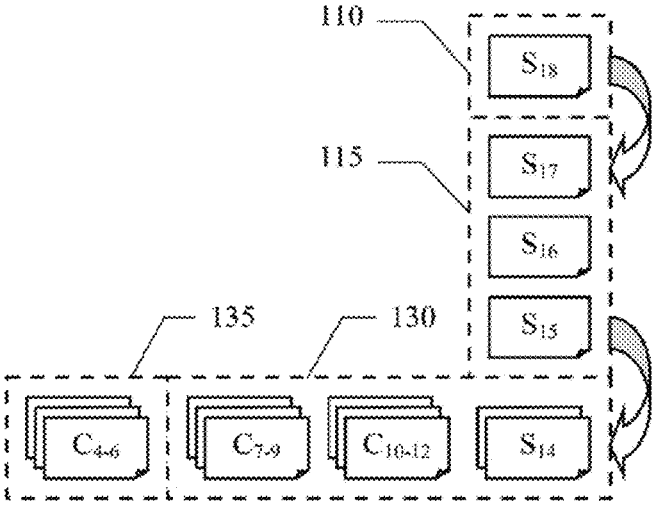

Considering now the FIG. 4C together with the FIG. 4B, during a next operative cycle of the feeding station 115, the transport station 130 and the sewing station 135 are instead maintained not working. Therefore, the simple signatures $S_{14}$, $S_{15}$ and $S_{16}$ move forward in the feeding station 115, so that the simple signature $S_{14}$ is supplied to the transport station 130; in such case, the simple signature $S_{14}$ is deposited onto the simple signature $S_{13}$ (stopped in front of the feeding station 115), so as to add to the new overlapped signature in the making. Moreover, the simple signature $S_{17}$ passes from the hopper 110 to the feeding station 115, so that a further simple signature $S_{18}$ goes to the bottom of the hopper 110.

Figure 4D:
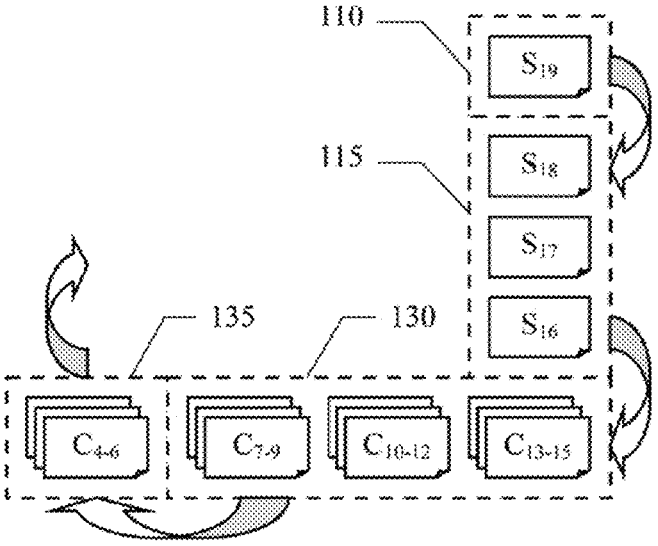

Likewise, as shown in the FIG. 4D together with the FIG. 4C, during a next operative cycle of the feeding station 115, the transport station 130 and the sewing station 135 are still maintained not working. Therefore, the simple signatures $S_{15}$, $S_{16}$ and $S_{17}$ moves forward in the feeding station 115, so that the simple signature $S_{15}$ is supplied to the transport station 130; in this way, the simple signature $S_{15}$ is deposited onto the simple signature $S_{14}$, so as to complete the new overlapped signature (denoted with the reference $C_{13-15}$). Moreover, the simple signature $S_{18}$ passes from the hopper 110 to the feeding station 115, so that a further simple signature $S_{19}$ goes to the bottom of the hopper 110. The same operations described-above are then repeated cyclically.

Alternatively, as shown in the FIG. 5A-FIG. 5D, the same result may be obtained (in case the sewing machine is provided with distinct motors for the transport station 130 and the sewing station 135) by only stopping the transport station 130 during the formation of each overlapped signature by the feeding station 115, while the sewing station 135 is instead driven continuously but at an operative frequency reduced with respect to the one of the feeding station 115 (by a factor equal to the number of simple signatures of each overlapped signature). Such solution allows only stopping the feeding station 130, which has a negligible inertia that does not involve any problem for its re-starting—while the sewing station 135 (in any case with a greater inertia) is maintained always working (at reduced operative frequency).

For example, in the same case as above wherein each overlapped signature is formed by 3 simple signatures, the sewing station 135 has an operative frequency equal to ⅓ of the operative frequency of the feeding station 115; therefore, during each operative cycle of the feeding station 115 (defined by its phase $\Phi_f$ from 0° to 360°, equal to a complete turn of a shaft of the corresponding motor), the sewing station 135 completes a fraction—i.e., ⅓—of its operative cycle (defined by its phase $\Phi_s$ from 0° to 120°, from 120° to 240°, and 240° to 360°, respectively, of a complete turn of a shaft of the corresponding motor).

Figure 5A:
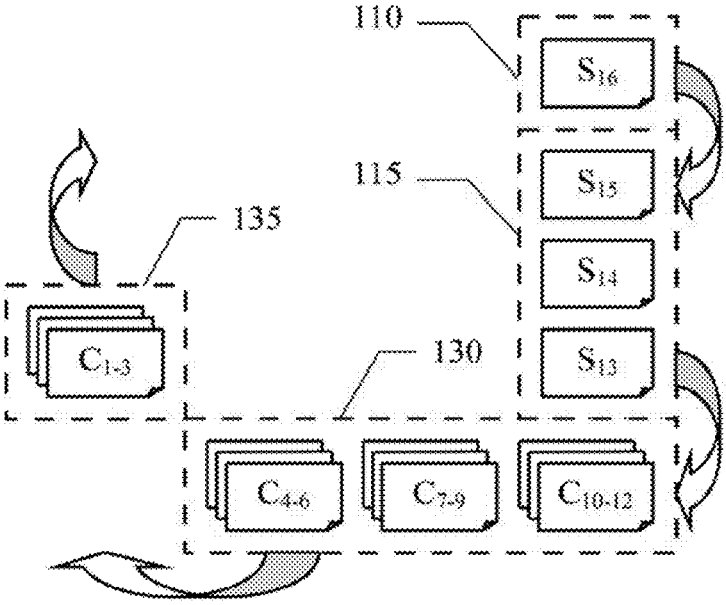
FIG. 5A-FIG. 5D show another further example of application of the solution according to an embodiment of the invention.

In this respect, the situation illustrated in the FIG. 5A is considered, wherein the sewing station 135 is at the phase $\Phi_s$=240°; in this condition, an overlapped signature $C_{1-3}$ has just been sewn in the sewing station 135; at the same time, a series of overlapped signatures $C_{4-6}$, $C_{7-9}$ and $C_{10-12}$ is present in the transport station 130, a series of simple signatures $S_{13}$, $S_{14}$ and $S_{15}$ is present in the feeding station 115, and a simple signature $S_{16}$ is present at the bottom of the hopper 110.

Figure 5B:
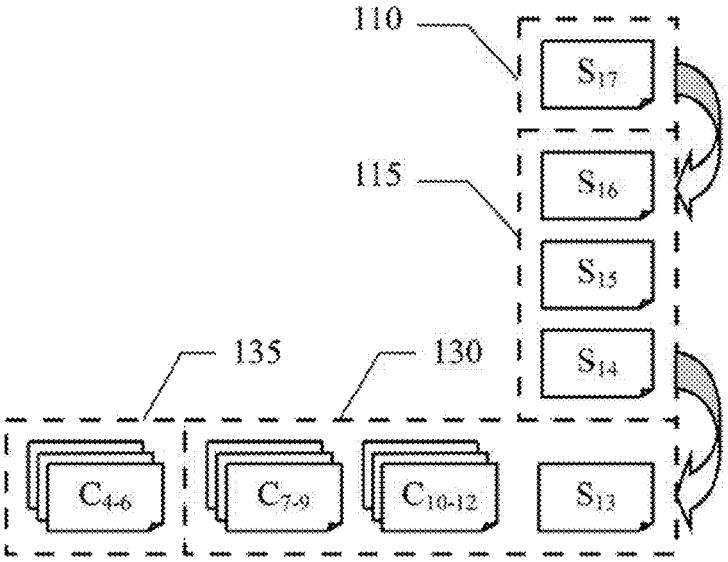

During a last fraction of an operative cycle of the sewing station 135 (phase $\Phi_s$=240°-360°), the transport station 130 and the feeding station 115 perform corresponding complete operative cycles (equal to each other); therefore, as shown in the FIG. 5B together with the FIG. 5A, the sewing station 135 completes the processing of the corresponding overlapped signature, while each one of the stations 115 and 130 processes a corresponding (simple and overlapped, respectively) signature. Particularly, the movable saddle of the sewing station 135 opens, so that the overlapped signature $C_{1-3}$ releases the sewing station 135 (by slipping off the movable saddle). At the same time, the overlapped signatures $C_{4-6}$, $C_{7-9}$ and $C_{10-12}$ move forward in the transport station 130, so that the overlapped signature $C_{4-6}$ is supplied to the sewing station 135 (by throwing it onto its movable saddle in open position), and a position is released in the transport station 130 in front of the feeding station 115. Moreover, the simple signatures $S_{13}$, $S_{14}$ and $S_{15}$ move forward in the feeding station 115, so that the simple signature $S_{13}$ is supplied to the transport station 130 (for starting the formation of a new overlapped signature). At the end, the simple signature $S_{16}$ passes from the hopper 110 to the feeding station 115, so that a further simple signature $S_{17}$ goes to the bottom of the hopper 110.

Figure 5C:
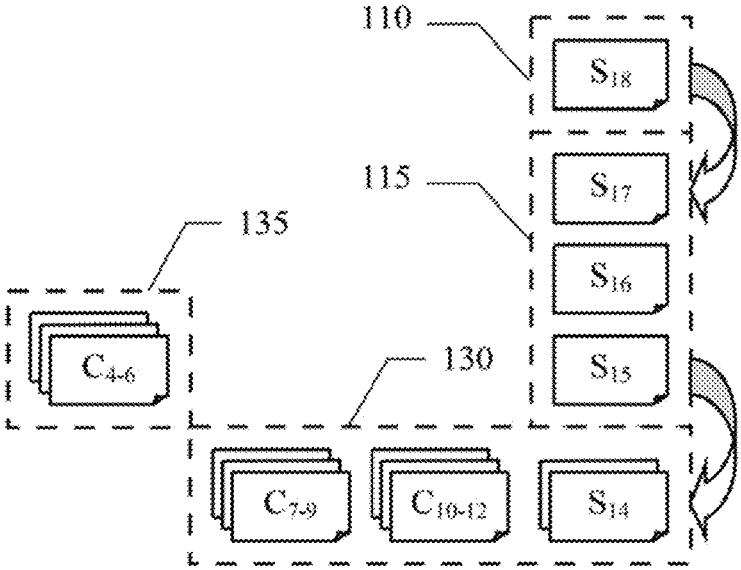

Considering now the FIG. 5C together with the FIG. 5B, during a first fraction of a next operative cycle of the sewing station 135 (phase $\Phi_S$=0°-120°), the feeding station 115 performs a next complete operative cycle thereof, while the transport station 130 is maintained not working. Therefore, the movable saddle of the sewing station 135 is closed and starts sewing the overlapped signature $C_{4-6}$. At the same time, the simple signatures $S_{14}$, $S_{15}$ and $S_{16}$ move forward in the feeding station 115, so that the simple signature $S_{14}$ is supplied to the transport station 130; in such case, the simple signature $S_{14}$ is deposited onto the simple signature $S_{13}$ (stopped in front of the feeding station 115), so as to add to the new overlapped signature in the making. Moreover, the simple signature $S_{17}$ passes from the hopper 110 to the feeding station 115, so that a further simple signature $S_{18}$ goes to the bottom of the hopper 110.

Figure 5D:
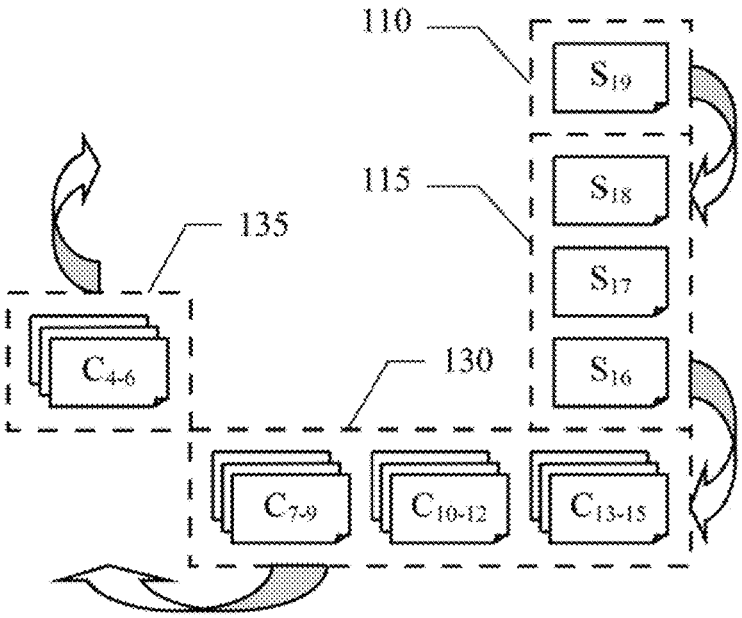

During a second fraction of the operative cycle of the sewing station 135 (phase $\Phi_S$=120°-240°), as shown in the FIG. 5D together with the FIG. 5C, the feeding station 115 performs another complete operative cycle thereof, while the transport station 130 is still maintained not working. Therefore, the sewing of the overlapped signature $C_{4-6}$ is completed in the sewing station 135. At the same time, the simple signatures $S_{15}$, $S_{16}$ and $S_{17}$ move forward in the feeding station 115, so that the simple signature $S_{15}$ is supplied to the transport station 130; in this way, the simple signature $S_{15}$ is deposited onto the simple signature $S_{14}$, so as to complete the new overlapped signature (denoted with the reference. $C_{13-15}$). Moreover, the simple signature $S_{18}$ passes from the hopper 110 to the feeding station 115, so that a further simple signature $S_{19}$ goes to the bottom of the hopper 110. The same operations described above are then repeated cyclically.

Figure 6A:
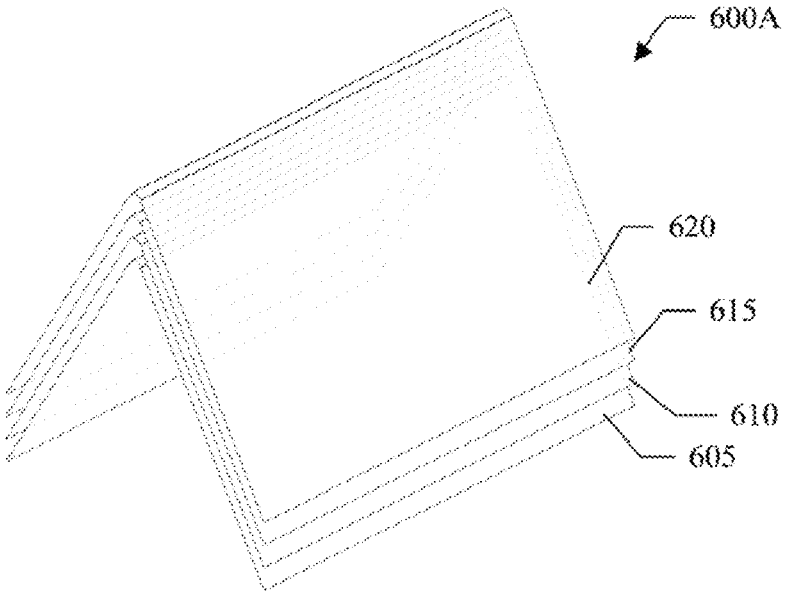
FIG. 6A-FIG-6B show various examples of overlapped signatures that may be obtained by applying the solution according to an embodiment of the invention.
Figure 6B:
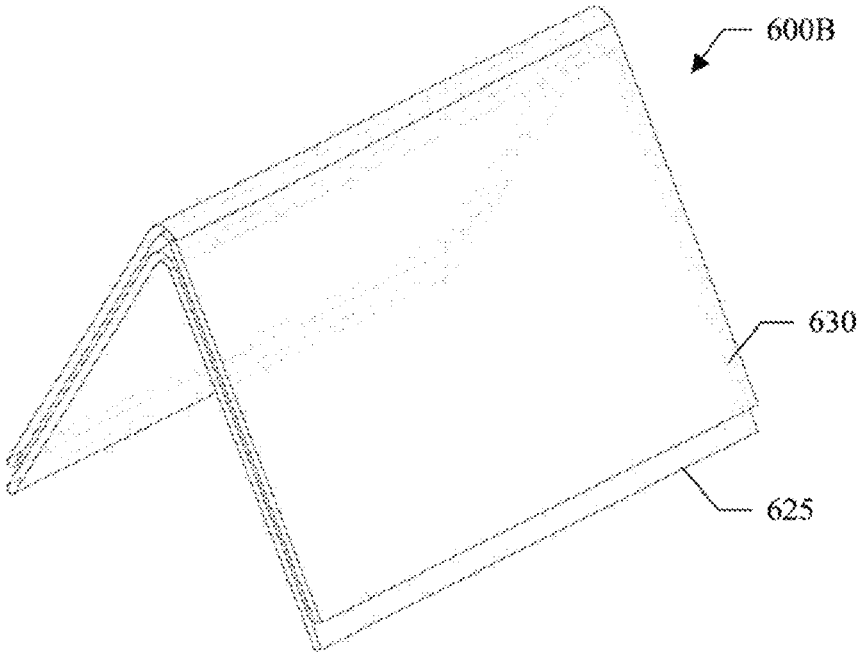

Passing to the FIG. 6-A-FIG-6B, various examples of overlapped signatures are shown that may be obtained by applying the solution according to an embodiment of the invention.

In particular, the FIG. 6A shows an overlapped signature 600A, which comprises 16 pages (in jargon, a sixteen-page signature). The overlapped signature 600A is formed by 4 simple signatures 605, 610, 615, and 620 being stacked one on top of the other, each one of them comprising 4 pages only. (i.e., a four-page signature).

The FIG. 6B instead shows an overlapped signature 600B, which again comprises 16 pages (i.e., a sixteen-page signature). In this case, the overlapped signature 600B is formed by 2 simple signatures 625 and 630 being stacked one on top of the other, each one of them comprising 8 pages (in jargon, a eight-page signature).

Figure 7:
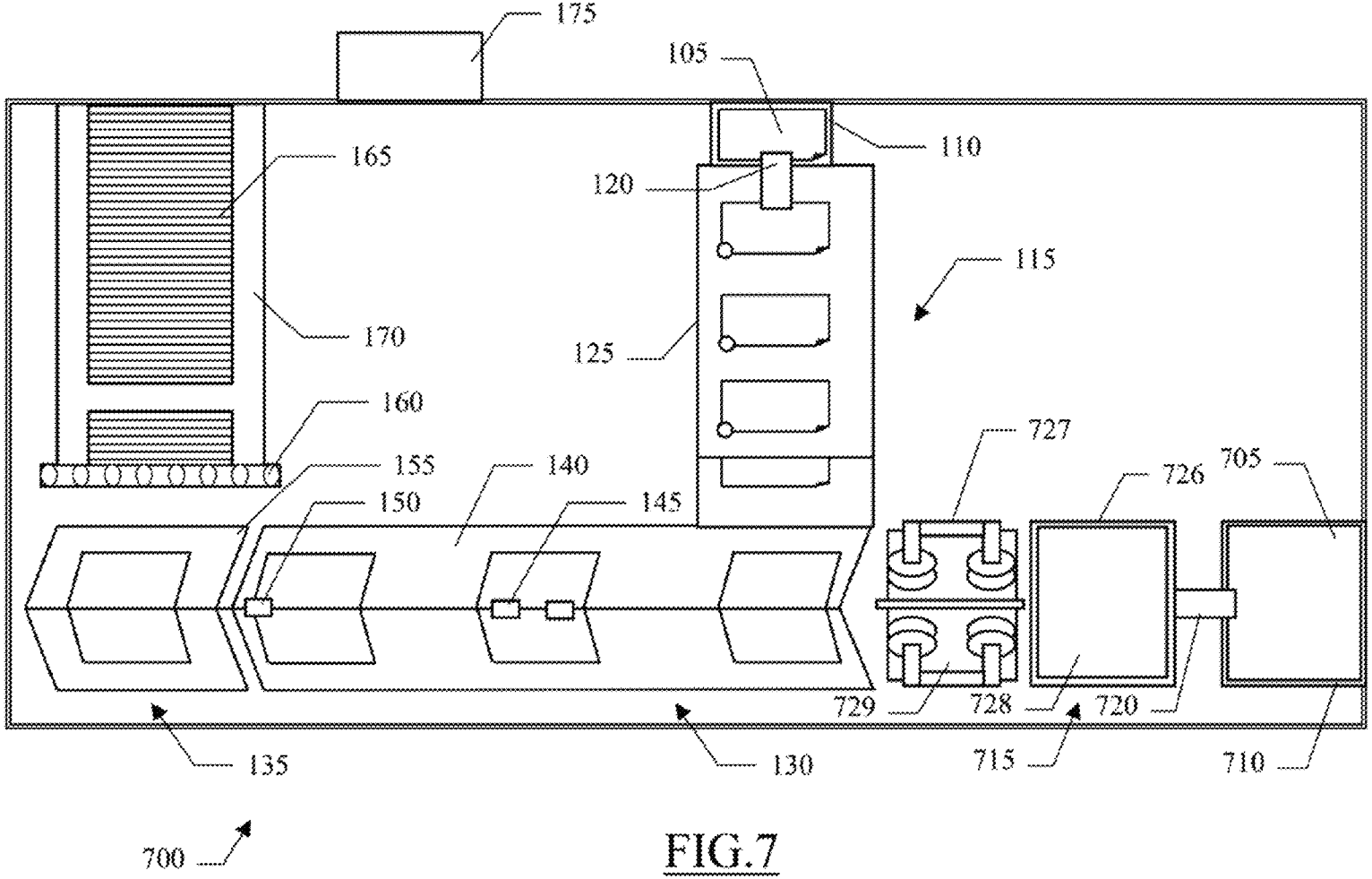
FIG. 7 shows a pictorial representation of a different bookbinding sewing machine wherein the solution according to an embodiment of the invention may be applied.

With reference now to the FIG. 7, a pictorial representation is shown of a different bookbinding sewing machine 700 wherein the solution according to an embodiment of the invention may be applied.

As above, the sewing machine 700 comprises a hopper 110 for loading the stack of signatures 105, the feeding station 115 (with the extraction device 120 and the opening device 125), the transport station 130 (with the fixed saddle 140, the shaping station 145, and the throwing wheel 150), the sewing station 135 (with the movable saddle 155 and the sewing head 160), the output conveyor 170 for receiving the book blocks 165, and the controller 175.

In the solution according to an embodiment of the invention, the sewing machine 700 is also capable of making, in a single passage, gathering, folding and sewing operations of (flat) printed sheets 705, which are generally, but not necessarily, supplied by digital printers (not shown in the figure)—analogously to what happens in the known combined sewing machines (for example, as described in the above-mentioned document EP-A-0846573). For this purpose, the sewing machine 700 comprises a further hopper 710, which is used for loading a stack of sheets 705 (grouped in blocks, each one for a correspondent book). The sewing machine 700 is then provided with another feeding station 715. Particularly, the feeding station 715 comprises an extraction device 720, a gathering device 726 and a folding device 727. The extraction device 720 (for example, sucker-based) extracts the sheets 705 in succession from the top of the hopper 710 (wherein they are maintained pushed upwards, so as to be always aligned with the extraction device 720), and it supplies them to the gathering device 726. In the gathering device 726, the sheets 705 are stacked one on top of the other so as to add to a current group of sheets 728 in the making. As soon as the group of (one or more) sheets 728 is completed (with all the sheets 705 of a corresponding current signature), the group of sheets 728 is transferred from the gathering device 726 to the folding device 727 that folds it so as to obtain such signature, denoted with the reference 729. Particularly, the group of sheets 728 is placed onto a chute (or any other plate), which is provided with a slit arranged parallel to a feeding direction of the group of sheets 728. A blade is extracted through the slit of the chute, so as to fold the group of sheets 728 in a central portion thereof that is brought inside a pair of jaws above the chute. The blade is then retracted under the chute and the jaws are tightened so as to form the signature 729. At this point, the jaws are opened and the signature 729 so obtained is supplied to the transport station 130 (with the signature 729, already opened in part, which is placed astride its fixed saddle). The operation of the feeding station 715 as well is managed by the controller 175.

Figure 8:
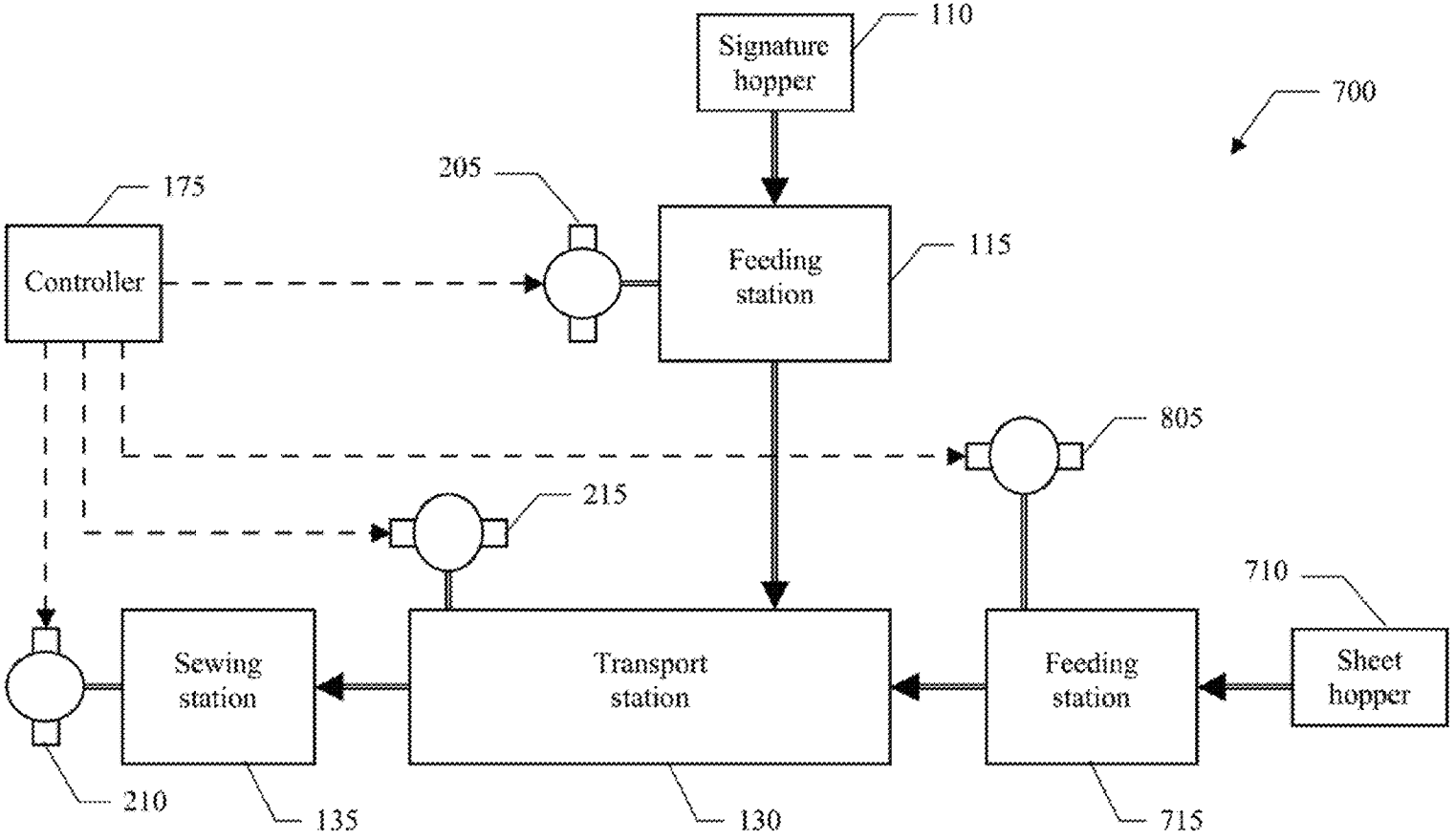
FIG. 8 shows a functional block diagram of such sewing machine according to an embodiment of the invention.

A functional block diagram of the sewing machine 700 according to an embodiment of the invention is shown in the FIG. 8. As above, the sewing machine 700 is provided with two distinct motors 205 and 210 for driving the feeding station 115 and the sewing station 135, respectively, and with a possible further motor 215 for driving the transport station 130, which are controlled independently by the controller 175.

In the solution according to an embodiment of the invention, the feeding station 715 is driven independently of the feeding station 115 (and then of the sewing station 135, and possibly of the transport station 130 as well). Particularly, in a specific implementation the sewing machine 700 is provided with a further motor 805 (with respective encoder or revolver) for driving the feeding station 715; in this case, the controller 175 controls all the motors 205, 210, 215 and 805 independently during the processing, of the signatures (with the possibility of stopping the corresponding stations selectively and/or operating them at different speed).

The above-described structure allows making the sewing machine 700 multi-function, since (as described in detail in the following) it is capable of processing both the signatures being supplied already ready (as in the traditional sewing machines) and the signatures being formed from the sheets (as in the combined sewing machines); moreover, such sewing machine 700 is extremely versatile, since such signatures may be processed in any desired way, either alternated or combined among them. This allows exploiting the advantages of both the traditional sewing machines and the combined sewing machines without the respective drawbacks; for example, it is possible always to use the (faster) signatures being supplied already ready, and the signatures being formed from the sheets only when it is necessary (for example, for adding inserts).

Particularly, the sewing machine 700 may be used for sewing together signatures being supplied already ready like in a stand-alone traditional sewing machine; for this purpose, the controller 175 only drives the feeding station 115, the transport station 130 and the sewing station 135—while the feeding station 715 is always maintained not working. In this way, it is possible to sew simple signatures together (analogously to what has been described with respect to the FIG. 3A-FIG. 3B), or forming and sewing together overlapped signatures (analogously to what has been described with respect to the FIG. 4A-FIG. 4D and/or to the FIG. 5A-FIG. 5D).

Moreover, the sewing machine 700 may be used for sewing together the signatures formed from the sheets like in a stand-alone combined sewing machine; for this purpose, the controller 175 only drives the feeding station 715, the transport station 130 and the sewing station 135—while the feeding station 115 is always maintained not working.

Figure 9A:
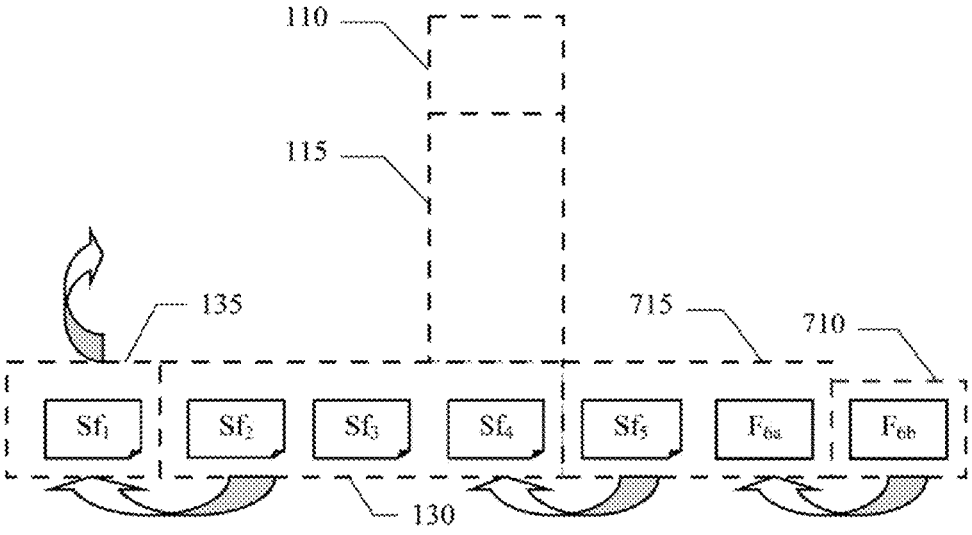
FIG. 9A-FIG. 9C show an example of application of the solution according to an embodiment of the invention.
Figure 9B:
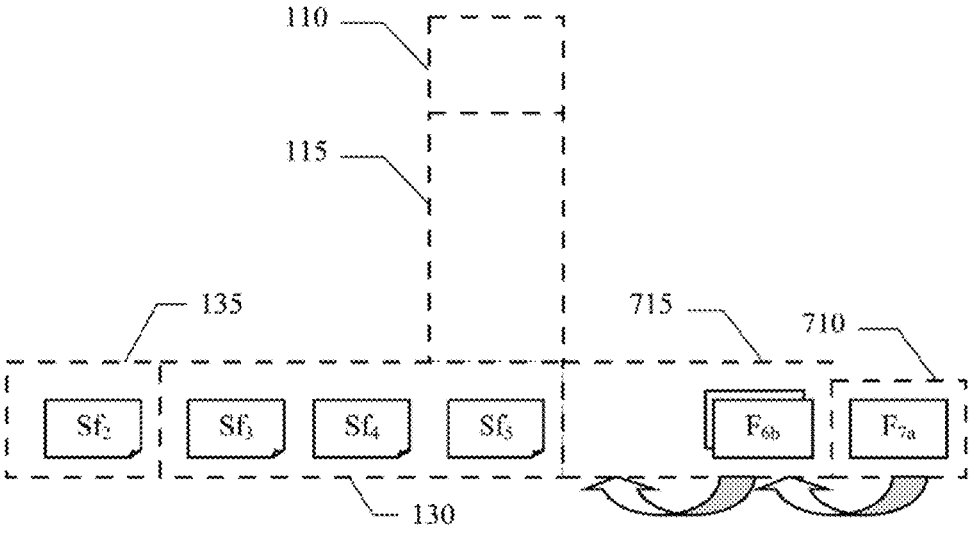
Figure 9C:
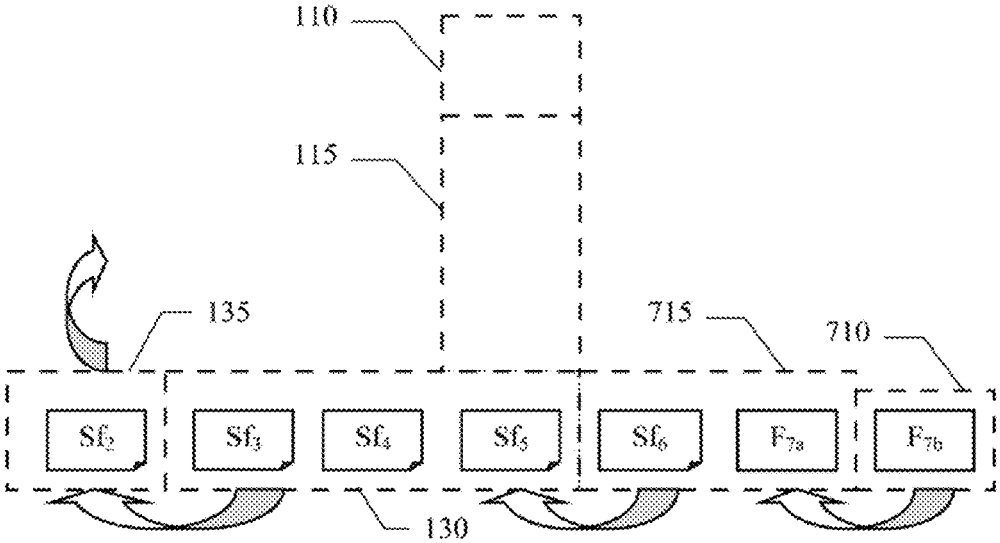

A corresponding example of application of the solution according to an embodiment of the invention is shown in the FIG. 9A-FIG. 9C.

Particularly, in case of signatures each one formed by two sheets, the situation illustrated in the FIG. 9A is considered, wherein a signature $Sf_1$ is present in the sewing station 135, a series of signatures $Sf_2$, $Sf_3$ and $Sf_4$ is present in the transport station 130, a signature $Sf_5$ (already formed in the folding device) and a sheet $F_{6a}$ (placed on the gathering device for starting the formation of a new block of sheets) is present in the feeding station 715, and a sheet $F_{6b}$ is present at the top of the hopper 710 (ready for being extracted).

During an operative cycle of the sewing station 135, an operative cycle of the transport station 130, and an operative cycle of the feeding station 715 (equal one to another), as shown in the FIG. 9B together with the FIG. 9A, the signature $Sf_1$ is sewn in the sewing station 135 to a current book block in the making, so as to release the sewing station 135. At the same time, the signatures $Sf_2$, $Sf_3$ and $Sf_4$ move forward in the transport station 130, so that the signature $Sf_2$ is supplied to the sewing station 135 and a position is released in the transport station 130 in front of the feeding stations 115 and 715. Moreover, the signature $Sf_5$ is supplied from the feeding station 715 to the transport station 130 (by depositing it into the free position of its fixed saddle). At the end, the sheet $F_{6b}$ passes from the hopper 710 to the feeding station 715 (deposited onto the sheet $F_{6a}$ for adding to the new block of sheets in the making), so that a further sheet $F_7$ goes to the top of the hopper 710.

Considering now the FIG. 9C together with the FIG. 98, during a next operative cycle of the feeding station 715, the transport station 130 and the sewing station 135 are instead maintained not working. Therefore, the (completed) block of sheets $F_{6a}$,$F_{6b}$ is moved in the feeding station 715 from the gathering device to the folding device for forming a new corresponding signature (denoted with the reference $Sf_6$), while the sheet $F_{7a}$ passes from the hopper 710 to the feeding station 715 (placed on its gathering device for starting the formation of a new block of sheets), so that a further sheet $F_{7b}$ goes to the top of the hopper 710. The same operations described-above are then repeated cyclically.

With reference now to the FIG. 10A-FIG-10D, the sewing machine may also be used for forming and sewing together overlapped signatures, each one of them being formed by signatures coming in part from the feeding station 115 (i.e., obtained by opening signatures being supplied already ready) and in part from the feeding station 715 (i.e., obtained by folding groups of sheets); for this purpose, during the formation of each overlapped signature the controller of the sewing machine alternatively drives the feeding station 115 and the feeding station 715 for supplying a corresponding signature to the transport station 130, which is instead maintained not working (with the sewing station 135 that is also maintained not working or driven at reduced operative frequency); moreover, the feeding station 715 may also be driven while the feeding station 115 supplies its own signatures to the transport station 130, so as to form, in the meantime, its own signature to be supplied later on to the transport station 130; this allows recovering, at least partially, the time required for the formation of the signatures in the feeding station 715 (with a beneficial effect on the yield of the entire sewing machine).

Figure 10A:
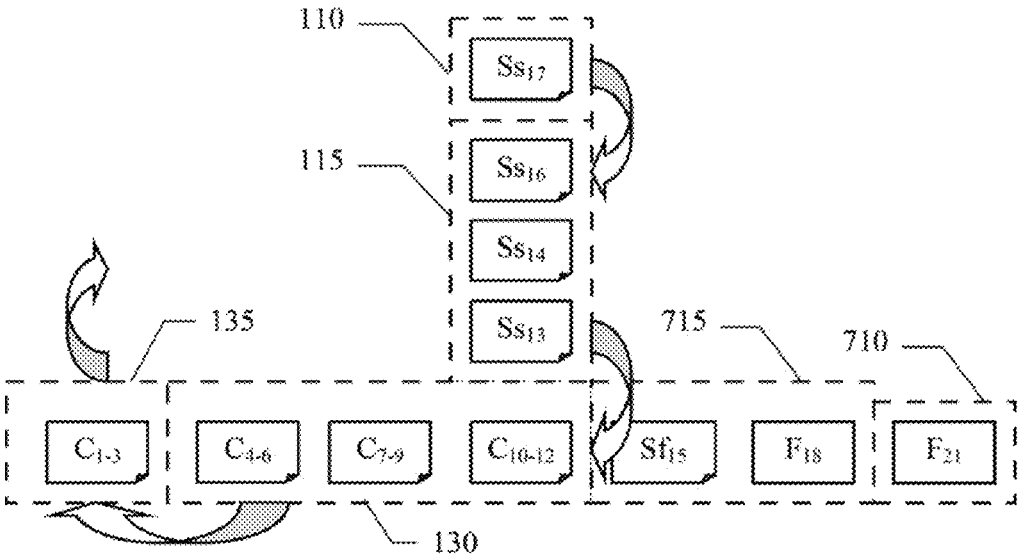
FIG. 10A-FIG. 10D show a further example of application of the solution according to an embodiment of the invention.

For example, in case of overlapped signatures each one formed by 2 signatures being supplied already ready (to the feeding station 115) and 1 signature being formed by folding a single sheet (in the feeding station 715), the situation illustrated in the FIG. 10A is considered, wherein an overlapped signature $C_{1-3}$ is present in the sewing station 135, a series of overlapped signatures $C_{4-6}$, $C_{7-9}$ and $C_{10-12}$ is present in the transport station 130, a series of simple signatures $Ss_{13}$, $Ss_{14}$ and $Ss_{16}$ is present in the feeding station 115, a simple signature $Ss_{17}$ is present at the bottom of the hopper 110, a simple signature $Sf_{15}$ (already formed in the folding device) and a sheet $F_{16}$ (placed on the gathering device for defining a corresponding block of sheets being already complete) are present in the feeding station 715, and a sheet $F_{21}$ is present at the top of the hopper 710.

Figure 10B:
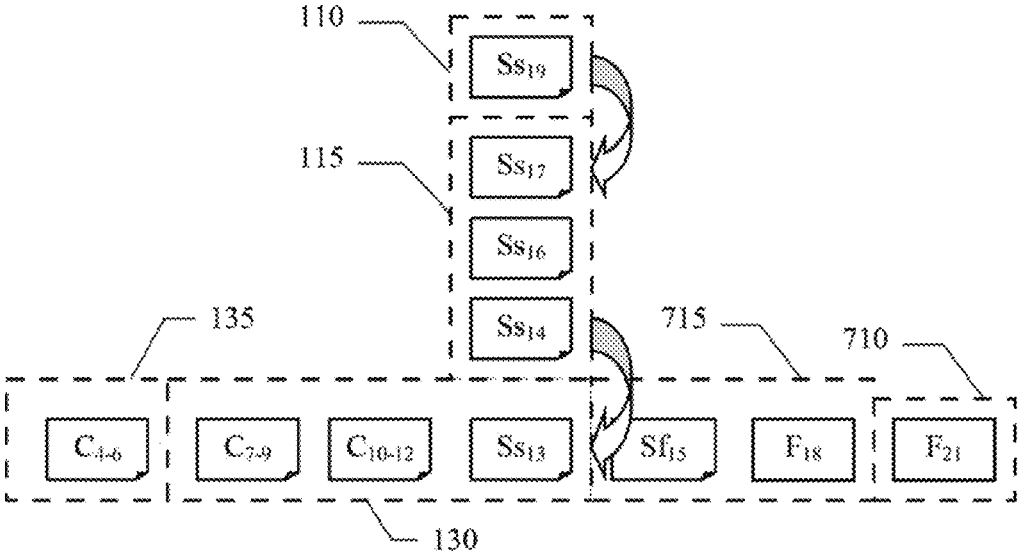

Considering now the FIG. 10B together with the FIG. 10A, during an operative cycle of the sewing station 135, the transport station 130 and the feeding station 115 (equal one to another), the feeding station 715 is instead maintained not working. Therefore, the overlapped signature $C_{1-3}$ is sewn in the sewing station 135 to a current book block in the making, so as to release the sewing station 135. At the same time, the overlapped signatures $C_{4-6}$, $C_{7-9}$ and $C_{10-12}$ move forwards in the transport station 130, so that the overlapped signature $C_{4-6}$ is supplied to the sewing station 135 and a position is released in the transport station 130 in front of the feeding stations 115 and 715. Moreover, the simple signatures $Ss_{13}$, $Ss_{14}$ and $Ss_{16}$ move forward in the feeding station 115, so that the simple signature $Ss_{13}$ is supplied to the transport station 130 (for starting the formation of a new overlapped signature). At the end, the simple signature $Ss_{17}$ passes from the hopper 110 to the feeding station 115, so that a further simple signature $Ss_{19}$ goes to the bottom of the hopper 110.

Figure 10C:
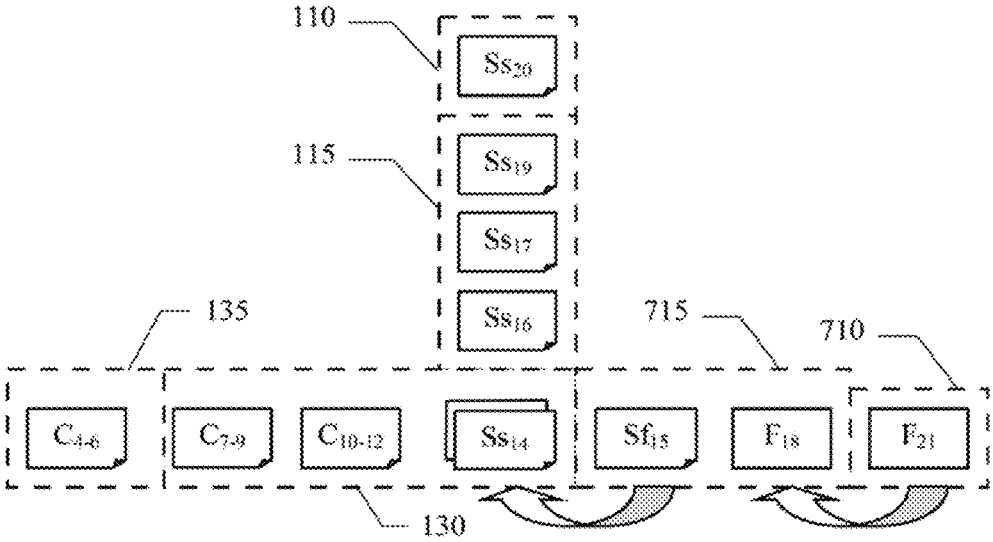

Moving to the FIG. 10C together with the FIG. 10B, during a next operative cycle of the feeding station 115, the sewing station 135, the transport station 130, and the feeding station 715 are all maintained not working. Therefore, the simple signatures $Ss_{14}$, $Ss_{16}$ and $Ss_{17}$ move forward in the feeding station 115, so that the simple signature $Ss_{14}$ is supplied to the transport station 130; in such case, the simple signature $Ss_{14}$ is deposited onto the simple signature $Ss_{13}$ (stopped in front of the feeding station 115), so as to add to the new overlapped signature in the making. Moreover, the simple signature $Ss_{19}$ passes from the hopper 110 to the feeding station 115, so that a further simple signature $Ss_{20}$ goes to the bottom of the hopper 110.

Figure 10D:
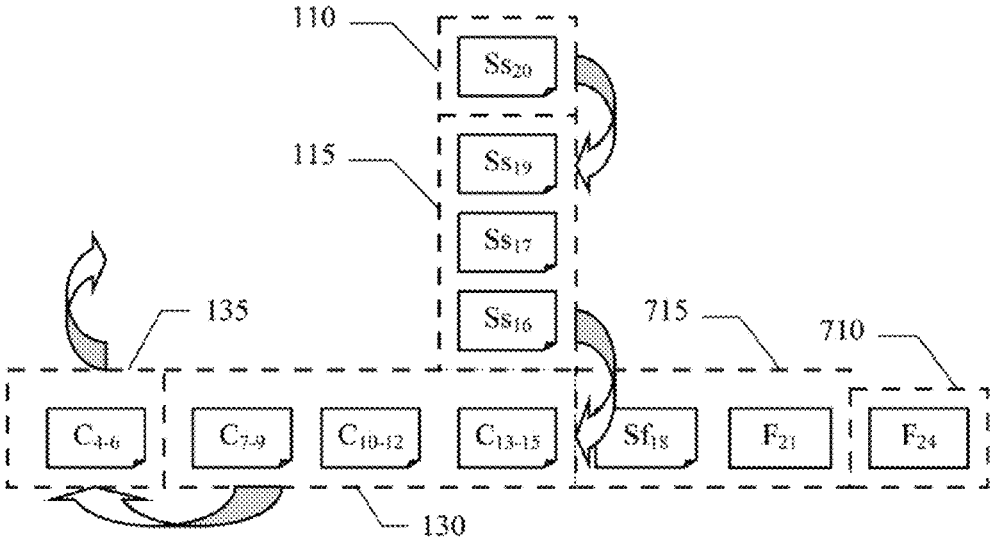

With reference now to the FIG. 10D together with the FIG. 10C, at this point the feeding station 715 performs an operative cycle thereof, while the feeding station 115, the sewing station 135 and the transport station 130 are maintained not working. Therefore, the simple signature $Sf_{15}$ is supplied from the feeding station 715 to the transport station 130; in this way, the simple signature $Sf_{15}$ is deposited onto the simple signature $Ss_{15}$, so as to complete the new overlapped signature (denoted with the reference $C_{13-15}$); at the same time, the (completed) block of sheets $F_{16}$ is moved in the feeding station 715 from the gathering device to the folding device for forming a new corresponding simple signature (denoted with the reference $Sf_{16}$), while the sheet $F_{21}$ passes from the hopper 710 to the feeding station 715 (placed on its gathering device for starting the formation of a new block of sheets), so that a further sheet $F_{24}$ goes to the top of the hopper 710. The same operations described-above are then repeated cyclically.

Figure 11:
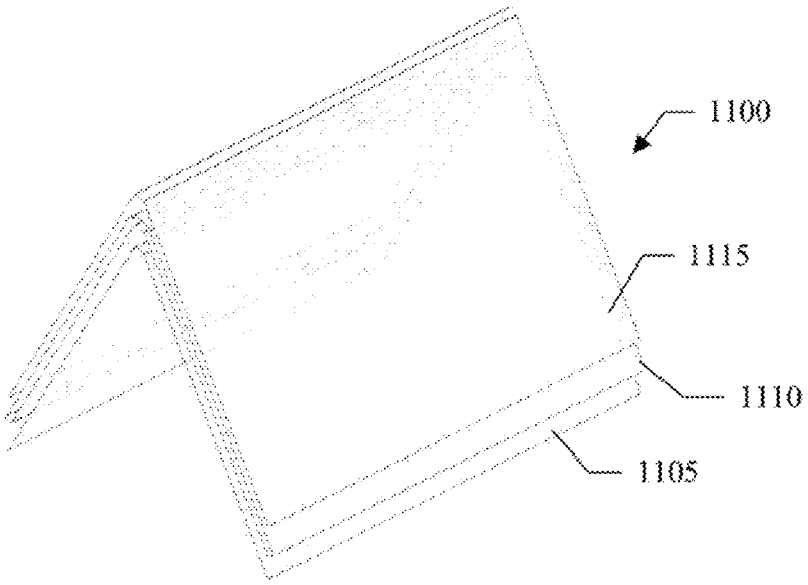
FIG. 11 shows an example of overlapped signature that may be obtained by applying the solution according to an embodiment of the invention.

Passing to the FIG. 11, an example of overlapped signature 1100 is shown that may be obtained by applying the solution according to an embodiment of the invention. Particularly, the overlapped signature 1100 comprises 16 pages (i.e., a sixteen-page signature). The overlapped signature 1100 is formed by 3 simple signatures 1105, 1110 and 1115 staked one on top of the other; the simple signature 1105 comprises 4 pages (i.e., a four-page signature), the simple signature 1110 comprises 8 pages (i.e., an eight-page signature), and the simple signature 1115 comprises 4 pages (i.e., a four-page signature). For example, the simple signatures 1105 and 1115 may be obtained by folding corresponding sheets, while the simple signature 1110 may be supplied already ready to be opened.

Naturally, in order to satisfy local and specific requirements, a person skilled in the art may apply to the solution described above many logical and/or physical modifications and alterations. More specifically, although this solution has been described with a certain degree of particularity with reference to one or more embodiments thereof, it should be understood that various omissions, substitutions and changes in the form and details as well as other embodiments are possible (for example, with respect to process parameters, materials and size). Particularly, different embodiments of the invention may even be practiced without the specific details (such as the numerical examples) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the disclosed solution may be incorporated in any other embodiment as a matter of general design choice. In any case, the terms include, comprise, have and contain (and any forms thereof) should be intended with an open, non-exhaustive meaning (i.e., not limited to the recited items), the terms based on, dependent on, according to, function of (and any forms thereof) should be intended as a non-exclusive relationship (i.e., with possible further variable involved), and the term a/an should be intended as one or more items (unless expressly indicated otherwise).

For example, similar considerations apply if the sewing machine has a different structure or comprises equivalent components, or is has different operative characteristics. In any case, every component thereof may be separated into more elements, or two or more components may be combined together into a single element; moreover, each component may be replicated to support the execution of the corresponding operations in parallel. It is also pointed out that (unless specified otherwise) any interaction between different components generally does not need to be continuous, and it may be either direct 5, or indirect through one or more intermediaries.

More generally, although in the preceding description specific reference has been made to a sewing machine, the same solution may find application in other binding machines as well (for example, wherein the signatures are joined together with staples). Moreover, the feeding, sewing and/or transport stations of the sewing machine may be controlled by means of equivalent devices (for example, an external computer).

The sewing machine may be controlled in any other way (by controlling the feeding station, the transport station and/or the sewing station independently among them). For example, nothing prevents maintaining the sewing station and the transport station connected mechanically between them in a fixed way; in any case, the same solution also lends itself to be used in a sewing machine without any transport station (wherein the signatures are directly supplied from the feeding station to the sewing station).

Moreover, in a different embodiment of the invention two or more stations of the sewing machine share a same motor; in this case, their independent driving may be obtained with mechanical decoupling systems (for example, based on a corresponding gearbox).

The independent driving of the feeding station and of the sewing station (and possibly of the transport station as well) may also be exploited for other applications (in addition or in alternative to the formation of the overlapped signatures directly in the sewing machine).

For example, in order to make a blind stitch at the end of each book block (i.e., a sewing stitch without any signature for preventing the threads from re-entering into a last signature after their cut) it is possible to maintain the feeding station and possibly the transport station as well not working during an operative cycle of the sewing station. This allows avoiding the problems caused by the known techniques wherein the feeding station works continuously with only the hold (for example, sucker-based) of the extraction device that is disabled—with the risk that the signature at the bottom of the hopper is extracted in any case by adhesion with such suckers.

Another possible application consists in the automatic restoration of an empty position among the signatures being caused by a missed extraction of the corresponding signature from the hopper. In such case, in response to the detection of such error in the extraction device (for example, by means of a corresponding presence sensor) it is possible to drive the feeding station only (maintaining the transport station and the sewing station not working) until restoring the correct sequence of the signatures. This allows correcting the error automatically without the need of any manual intervention (with corresponding stop of the sewing machine).

Considering in particular the formation of the overlapped signatures in the sewing machine, the same result may however be obtained in various way.

For example, in case the transport station is lacking, it is enough to maintain the sewing station not working during the formation of each overlapped signature directly thereon by the feeding station.

Alternatively, it is possible to drive the transport station continuously as well but at an operative frequency being reduced with respect to the one of the feeding station (by a factor equal to the number of simple signatures of each overlapped signature); in such case, the pushing pegs of the fixed saddle are spaced apart so as to reach the position in front of the feeding station after the corresponding overlapped signature has been completed (with possible problems for the integrity of the overlapped signatures caused by their reaching at, high speed by the pushing pegs that may be solved through an additional pre-acceleration device of the signatures on the fixed saddle).

All the considerations pointed out above apply to the multifunction sewing machine as well. For example, the feeding stations may be in any other number and arranged in any other position (for example, with the feeding station providing the signatures already ready moved downstream along the transport station, with the feeding stations at opposite sides of the transport station, or with multiple feeding stations of every type alternated along the transport station).

Particularly, when the feeding stations feed the corresponding signatures to different positions along the fixed saddle, they may also be driven to work concurrently (at least in part) so as to stack, the simple signatures of different composite signatures onto the fixed saddle at the same time (so as to recover, at least partially, the time required for the formation of the composite signatures—with a beneficial effect on the yield of the entire sewing machine).

Moreover, the signatures being formed from the sheets may have any number of folds (such as multiple crossing folds), which may be obtained by multiple passages through a single folding element or by passing through multiple folding elements in succession. In any case, the same signatures may be formed by folding (one or more times) pre-signatures lacking corresponding last folds.

Alternatively, the feeding station providing the signatures being formed from the sheets may only comprise a folding device without any gathering device (with each sheet that is folded individually and then supplied to the transport station directly); for example, the folding device may comprise a pair of belts, which transports each sheet extracted from the hopper through a pair of creasing rollers and then through a bank of one or more pairs of folding rollers. In this case, it is also possible to stack two or more signatures being formed from the sheets on the transport station (in front of the corresponding feeding station) and to move them in front of the other feeding station (for adding possible further signatures).

The multi-function sewing machine may be controlled in any other way. For example, the feeding stations may be driven at different operative frequencies (for example, with the feeding station providing the signatures being formed from the sheets that is faster than the feeding station providing the signatures already ready).

In a basic implementation, it is possible only to control the two feeding stations independently (while the feeding station of the signatures being supplied already ready is connected mechanically in a fixed way to the transport and sewing stations like in the standard sewing machines).

Moreover, the two feeding stations may only be used alternatively (for obtaining book blocks completely formed by signatures being supplied already ready or by signatures being formed from the sheets), the feeding station of the signatures being supplied already ready may only be used for sewing the signatures as they are supplied (without overlapping them), and so on.

It should be noted that the proposed solution also lends itself to be implemented and put on the market as a modification kit for its application to standard sewing machines (for example, for the addition of the feeding station of the signatures being formed from the sheets).

The same solution may be put into practice with an equivalent method (by using similar steps with the same functions of more steps or portions thereof, removing some steps being non-essential, or adding further optional steps); moreover, the steps may be performed in a different order, concurrently or in an interleaved way (at least in part).

Moreover, it is possible to implement the proposed solution as a stand-alone module, as a plug-in for a control program of the sewing machine, or even directly in the control program itself. Alternatively, the same solution may be applied in a system comprising a sewing machine and a separate computer (or any equivalent data-processing system). Similar considerations apply if the program (which may be used to implement each embodiment of the invention) has any other form suitable to be used by any data-processing system or in connection therewith; moreover, it is possible to provide the program on any computer-usable medium, and particularly as an article of manufacture on a non-transitory medium (for example, of magnetic type). In any case, the solution according to an embodiment of the present invention lends itself to be implemented even with a hardware structure (for example, integrated in a chip of semiconductor material), or with a combination of software and hardware suitably programmed or otherwise configured.

The invention claimed is:

1. A multi-function binding machine comprising:

a binding station for binding blocks of signatures;

a hopper for loading a stack of folded signatures;

a feeding station for extracting the signatures in succession from the hopper, opening the signatures, and feeding the signatures to the binding station;

an additional hopper for loading a stack of pre-signatures to be folded; and an additional feeding station for extracting the pre-signatures in successions from the additional hopper, folding groups of at least one pre-signature into additional signatures, and feeding the additional signatures to the binding station;

a binding driving means for driving the binding station;

a feeding driving means for driving the feeding station;

an additional feeding driving means for driving the additional feeding station; and a control means for controlling the binding means, the feeding driving means and the additional feeding driving means independently to stop the binding station while the feeding station and the additional feeding station are controlled to stack a plurality of signatures and/or additional signatures thereby forming a composite signature for the binding in the binding station.

2. The multi-function binding machine according to claim 1, further comprising a transport station for receiving the signatures from the feeding station and the additional signatures from the additional feeding station, and for transporting the signatures and the additional signatures to the binding station.

3. The multi-function binding machine according to claim 2, wherein the transport station comprises a fixed saddle for transporting the signatures and the additional signatures along a transport direction, the feeding station being arranged sideways the fixed saddle along the transport direction and the additional feeding station being arranged in line with the fixed saddle at a start end of the fixed saddle along the transport direction.

4. The multi-function binding machine according to claim 2, further comprising transport driving means for driving the transport station, the control means being further adapted to control the transport driving means independently of the binding driving means, the feeding driving means, and/or the additional feeding driving means.

5. The multi-function binding machine according to claim 4, wherein the control means comprises means for stopping the transport station while the feeding station and/or the additional feeding station stacks the signatures and/or the additional signatures, respectively, of the composite signature in the transport station.

6. The multi-function binding machine according to claim 1, wherein each pre-signature consists of a flat sheet.

7. The multi-function binding machine according to claim 1, wherein each group of pre-signatures consists of a single pre-signature.

8. The multi-function binding machine according to claim 1, the composite signature comprises at least one signature and at least one additional signature.

9. The multi-function binding machine according to claim 1, wherein the binding driving means comprises a binding motor for driving the binding station, the feeding driving means comprises a feeding motor for driving the feeding station, the additional feeding driving means comprises an additional feeding motor (805) for driving the additional feeding station, the control means being adapted to control the binding motor, the feeding motor, and the additional feeding motor independently.

10. The multi-function binding machine according to claim 1, wherein the control means comprises means for stopping the feeding station and the additional feeding station to cause the binding station to perform a blind stitch.

11. A multi-function binding machine comprising:

a binding station for binding blocks of signatures;

a hopper for loading a stack of folded signatures, a feeding station for extractin the s natures in succession from the hopper, opening the signatures, and feeding the signatures to the binding station;

an additional hopper for loading a stack of pre-signatures to be folded;

an additional feeding station for extracting the pre-signatures in successions from the additional hopper, folding groups of at least one pre-signature into additional signatures, and feeding the additional signatures to the binding station;

a binding driving means for driving the binding station;

a feeding driving means for driving the feeding station;

an additional feeding driving means for driving the additional feeding station; and a control means for controlling the binding driving means the feeding driving means and the additional feeding driving means independently, the control means comprising means for detecting an error caused by a missing signature and/or a missing additional signature in the feeding station and/or in the additional feeding station, respectively, and means for stopping the binding station to cause the feeding station and/or the additional feeding station to restore the missing signature.

12. A method for controlling a multi-function binding machine comprising the steps of:

driving a binding station for binding blocks of signatures;

driving a feeding station for extracting signatures in succession from a hopper loading a stack of folded signatures, opening the signatures, and feeding the signatures to the binding station; and driving an additional feeding station for extracting pre-signatures in successions from an additional hopper loading a stack of pre-signatures to be folded, folding groups of at least one pre-signature into additional signatures, and feeding the additional signatures to the binding station, and controlling binding driving means for driving the binding station, feeding driving means for driving the feeding station and additional feeding driving means for driving the additional feeding station independently to stop the binding station while the feeding station and the additional feeding station are controlled to stack a plurality of signatures and/or additional signatures thereby forming a composite signature for the binding in the binding station.

13. The method according to claim 12, further comprising the step of driving a transport station for receiving the signatures from the feeding station and the additional signatures from the additional feeding station, and for transporting the signatures and the additional signatures to the binding station.

14. The method according to claim 12, wherein each pre-signature consists of a flat sheet.

15. The method according to claim 12, wherein each group of pre-signatures consists of a single pre-signature.

16. The method according to claim 12, wherein the composite signature comprises at least one signature and at least one additional signature.

17. The method according to claim 12, further comprising the step of controlling transport driving means for driving the transport station independently of the binding driving means, the feeding driving means, and/or the additional feeding driving means.

18. The method according to claim 17, further comprising the step of stopping the transport station while the feeding station and/or the additional feeding station stacks the signatures and/or the additional signatures, respectively, of the composite signature in the transport station.

19. The method according to claim 12, further comprising the step of stopping the feeding station and the additional feeding station to cause the binding station to perform a blind stitch.

20. A method for controlling a multi-function binding machine comprising the steps of:

driving binding station for binding blocks of signatures;

driving a feeding station for extracting signatures in succession from a hopper loading a stack of folded signatures, opening the signatures, and feeding the signatures to the binding station;

driving an additional feeding station for extracting pre-signatures in successions from an additional hopper loading a stack of pre-signatures to be folded,folding groups of at least one pre-signature into additional signatures, and feeding the additional signatures to the binding station, detecting an error caused by a missing signature and/or a missing additional signature in the feeding station and/or the additional feeding station, respectively, and controlling binding driving means for driving the binding station, feeding driving means for driving the feeding station and additional feeding driving means for driving the additional feeding station independently to stop the binding station to cause the feeding station and/or the additional feeding station to restore the missing signature.

21. A computer program product comprising a non-transitory computer readable medium embodying a computer program, the computer program being loadable into a working memory of a data-processing system thereby configuring the data-processing system to perform a method for controlling a multi-function binding machine comprising the steps of:

driving a binding station for binding blocks of signatures driving a feeding station for extracting signatures in succession from a hopper loading a stack of folded signatures, opening the signatures, and feeding the signatures to the binding station;

driving an additional feeding station for extracting pre-signatures in successions from an additional hopper loading a stack of pre-signatures to be folded, folding groups of at least one pre-signature into additional signatures, and feeding the additional signatures to the binding station; and controlling binding driving means for driving the binding station, feeding driving means for driving the feeding station and additional feeding driving means for driving the additional feeding station independently to stop the binding station while the feeding station and the additional feeding station are controlled to stack a plurality of signatures and/or additional signatures thereby forming a composite signature for the binding the binding station.

22. A binding machine comprising:

a binding station for binding blocks of signatures;

a feeding station for receiving signatures in successions, opening the signatures, and feeding the signatures to the binding station;

a binding driving means for driving the binding station;

a feeding driving means for driving the feeding station; and a control means for controlling the binding driving means and the feeding driving means independently to stop the binding station while the feeding station is controlled to stack a plurality of signatures thereby forming a composite signature for the binding in the binding station.

23. The binding machine according to claim 22, further comprising a transport station for transporting the signatures in succession from the feeding station to the binding station, and transport driving means for driving the transport station, the control means being additional adapted to control the transport driving means independently of the binding driving means and/or the feeding driving means to stop the transport station while the feeding station stacks the sisnatures of the composite signature in the transport station.

24. The binding machine according to claim 22, wherein the binding driving means comprises a binding motor for driving the binding station, and the feeding driving means comprises a feeding motor for driving the feeding station, and the control means being adapted to control the binding motor and the feeding motor independently.

25. The binding machine according to claim 22, wherein the control means comprises means for stopping the feeding station to cause the binding station to perform a blind stitch.

26. The binding machine according to claim 22, wherein the transport driving means comprises a transport motor for driving the transport station, the control means being adapted to control the transport motor independently of the binding motor and of the feeding motor.

27. A binding machine comprising:

a binding station for binding blocks of signatures; a feeding station for receiving signatures in successions, opening the signatures and feeding the signatures to the binding station;

a binding driving means for driving the binding station;

a feeding driving means for driving the feeding station; and a control means for controlling the binding driving means and the feeding driving means independently to stop selectively the binding station and the feeding station during a processing of the signatures, the control means comprising means for detecting an error caused by a missing signature in the feeding station, and means for stopping the binding station to cause the feeding station to restore the missing signature.

28. A method for controlling a binding machine comprising the steps of:

driving a binding station for binding blocks of signatures;

driving a feeding station for receiving signatures in successions;

opening the signatures, and feeding the signatures to the binding station; and controlling binding driving means for driving the binding station and feeding driving means for driving the feeding station independently to stop selectively and/or to operate at different speeds the binding station while the feeding station is controlled to stack a plurality of signatures thereby forming a composite signature for the binding in the binding station.

29. The method according to claim 28, further comprising the steps of:

driving a transport station for transporting the signatures in succession from the feeding station to the binding station, and controlling transport driving means for driving the transport station independently of the binding driving means and/or the feeding driving means to stop the transport station while the feeding station stacks the signatures of the composite signature in the transport station.

30. The method according to claim 28, further comprising the step of stopping the feeding station to cause the binding station to perform a blind stitch.

31. A method for controlling a binding machine comprising the steps of:

driving a binding station for binding blocks of signatures;

driving a feeding station for receiving signatures in successions, opening the signatures, and feeding the signatures to the binding station;

detecting an error caused by a missing signature in the feeding station; and controlling binding driving means for driving the binding station and feeding driving means for driving the feeding station independently to stop the binding station to cause the feeding station to restore the missing signature.

32. A computer program product comprising a non-transitory computer readable medium embodying a computer program, the computer program being loadable into a working memory of a data-processing system thereby configuring the data-processing system to perform a method for controlling a binding machinecomprising the steps of:

driving a binding station for binding blocks of signatures;

driving a feeding station for receiving signatures in successions, opening the signatures, and feeding the signatures to the binding station; and controlling binding driving means for driving the binding station and feeding driving means for driving the feeding station independently to stop the binding station while the feeding station is controlled to stack a plurality of signatures thereby forming a composite signature for the binding in the binding station.

33. A multi-function binding machine comprising:

a binding station for binding blocks of signatures;

a hopper for loading a stack of folded signatures;

a transport station for transporting the signatures in succession to the binding station;

a feeding station for extracting the signatures in succession from the hopper, opening the signatures, and feeding the signatures to the transport station;

an additional hopper for loading a stack of pre-signatures to be folded;

an additional feeding station for extracting the pre-signatures in successions from the additional hopper, folding groups of at least one pre-signature into additional signatures, and feeding the additional signatures to the transport station;

a binding driving means for driving the binding station;

a transport driving means for driving the transport station;

a feeding driving means for driving the feeding station;

an additional feeding driving means for driving the additional feeding station; and a control means for controlling the binding driving means and the transport driving means independently of the feeding driving means and of the additional feeding driving means to stop the transport station and the binding station and/or to stop the transport station and to operate at different speeds the binding station with respect to the feeding station and/or the additional feeding station during a processing of the signatures to cause the feeding station and the additional feeding station to stack a plurality of signatures and/or additional signatures in the transport station thereby forming a composite signature for the binding in the binding station.

34. The multi-function binding machine according to claim 33, wherein the control means comprises means for reducing an operative frequency of the binding station with respect to an operative frequency of the feeding station and/or the additional feeding station according to a number of the corresponding signatures and/or additional signatures, respectively, forming the composite signature while the feeding station and/or the additional feeding station stacks the signatures and/or the additional signatures, respectively, of the composite signature.

35. A method for controlling a multi-function binding machine comprising the steps of:

driving a binding station for binding blocks of signatures;

driving a transport station for transporting the signatures in succession to the binding station;

driving a feeding station for extracting signatures in succession from a hopper loading a stack of folded signatures, opening the signatures, and feeding the signatures to the transport station;

driving an additional feeding station for extracting pre-signatures in successions from an additional hopper loading a stack of pre-signatures to be folded, folding groups of at least one pre-signature into additional signatures, and feeding the additional signatures to the transport station, and controlling binding driving means for driving the binding station and transport driving means for driving the transport station independently of feeding driving means for driving the feeding station and of additional feeding driving means for driving the additional feeding station to stop the transport station and the binding station and/or to stop the transport station and to operate at different speeds the binding station with respect to the feeding station and/or the additional feeding station during a processing of the signatures to cause the feeding station and the additional feeding station to stack a plurality of signatures and/or additional signatures in the transport station thereby forming a composite signature for the binding in the binding station.

36. The method according to claim 35, further comprising the step of reducing an operative frequency of the binding station with respect to an operative frequency of the feeding station and/or the additional feeding station according to a number of the signatures and/or the additional signatures, respectively, forming the composite signature while the feeding station and/or the additional feeding station stacks the signatures and/or the additional signatures, respectively, of the composite signature.

37. A computer program product comprising a non-transitory computer readable medium embodying a computer program, the computer program being loadable into a working memory of a data-processing system thereby configuring the data-processing system to perform a method for controlling a multi-function binding machine comprising the steps of:

driving a binding station for binding blocks of signatures;

driving a transport station for transporting the signatures in succession to the binding station;

driving a feeding station for extracting signatures in succession from a hopper loading a stack of folded signatures, opening the signatures, and feeding the signatures to the transport station;

driving an additional feeding station for extracting pre-signatures in successions from an additional hopper loading a stack of pre-signatures to be folded, folding groups of at least one pre-signature into additional signatures, and feeding the additional signatures to the transport station, and controlling binding driving means for driving the binding station and transport driving means for driving the transport station independently of feeding driving means for driving the feeding station and of additional feeding driving means for driving the additional feeding station to stop the transport station and the binding station and/or to stop the transport station and to operate at different speeds the binding station with respect to the feeding station and/or the additional feeding station during a processing of the signatures to cause the feeding station and the additional feeding station to stack a plurality of signatures and/or additional signatures in the transport station thereby forming a composite signature for the binding in the binding station.

38. A computer program product comprising a non-transitory computer readable medium embodying a computer program, the computer program being loadable into a working memory of a data-processing system thereby configuring the data-processing system to perform a method for controlling a multi-function binding machine comprising the steps of:

driving a binding station for binding blocks of signatures;

driving a feeding station for extracting signatures in succession from a hopper loading a stack of folded signatures, opening the signatures, and feeding the signatures to the binding station;

driving an additional feeding station for extracting pre-signatures in successions from an additional hopper loading a stack of pre-signatures to be folded, folding groups of at least one pre-signature into additional signatures, and feeding the additional signatures to the binding station, detecting an error caused by a missing signature and/or a missing additional signature in the feeding station and/or the additional feeding station, respectively, and controlling binding driving means for driving the binding station, feeding driving means for driving the feeding station and additional feeding driving means for driving the additional feeding station independently to stop the binding station to cause the feeding station and/or the additional feeding station to restore the missing signature.

39. A binding machine comprising:

a binding station for binding blocks of signatures;

a transport station for transporting the signatures in succession to the binding station;

a feeding station for receiving signatures in successions, opening the signatures, and feeding the signatures to the transport station;

a binding driving means for driving the binding station;

a transport driving means for driving the transport station;

a feeding driving means for driving the feeding station; and a control means for controlling the binding driving means and the transport driving means independently of the feeding driving means to stop the transport station and the binding station and/or to stop the transport station and to operate at different speeds the binding station and the feeding station during a processing of the signatures to cause the feeding station to stack a plurality of signatures in the transport station thereby forming a composite signature for the binding in the binding station.

40. The binding machine according to claim 39, wherein the control means comprises means for reducing an operative frequency of the binding station with respect to an operative frequency of the feeding station according to a number of signatures forming the composite signature while the feeding station stacks the signatures of the composite signature.

41. A method for controlling a binding machine comprising the steps of:

driving a binding station for binding blocks of signatures;

driving a transport station for transporting the signatures in succession to the binding station;

driving a feeding station for receiving signatures in successions, opening the signatures, and feeding the signatures to the transport station; and controlling binding driving means for driving the binding station and transport driving means for driving the transport station independently of feeding driving means for driving the feeding station to stop the transport station and the binding station and/or to stop the transport station and to operate at different speeds the binding station and the feeding station during a processing of the signatures to cause the feeding station to stack a plurality of signatures in the transport station thereby forming a composite signature for the binding in the binding station.

42. The method according to claim 41, further comprising the step of reducing an operative frequency of the binding station with respect to an operative frequency of the feeding station according to a number of signatures forming the composite signature while the feeding station stacks the signatures of each composite signature.

43. A computer program product comprising a non-transitory computer readable medium embodying a computer program, the computer program being loadable into a working memory of a data-processing system thereby configuring the data-processing system to perform a method for controlling a binding machine comprising the steps of:

driving a binding station for binding blocks of signatures;

driving a transport station for transporting the signatures in succession to the binding station;

driving a feeding station for receiving signatures in successions, opening the signatures, and feeding the signatures to the transport station; and controlling binding driving means for driving the binding station and transport driving means for driving the transport station independently of feeding driving means for driving the feeding station to stop the transport station and the binding station and/or to stop the transport station and to operate at different speeds the binding station and the feeding station during a processing of the signatures to cause the feeding station to stack a plurality of signatures in the transport station thereby forming a composite signature for the binding in the binding station.

44. A computer program product comprising a non-transitory computer readable medium embodying a computer program, the computer program being loadable into a working memory of a data-processing system thereby configuring the data-processing system to perform a method for controlling a binding machine comprising the steps of:

driving a binding station for binding blocks of signatures;

driving a feeding station for receiving signatures in successions, opening the signatures, and feeding the signatures to the binding station;

detecting an error caused by a missing signature in the feeding station; and controlling binding driving means for driving the binding station and feeding driving means for driving the feeding station independently to stop the binding station to cause the feeding station to restore the missing signature.

* * * * *

UNITED STATES PATENT AND TRADEMARK OFFICE

CERTIFICATE OF CORRECTION

PATENT NO. : 9,033,329 B2
APPLICATION NO. : 13/383757
DATED : May 19, 2015
INVENTOR(S) : Roberto Fustinoni and Guiseppe Andreoni It is certified that error appears in the above-identified patent and that said Letters Patent is hereby corrected as shown below:

In the claims

Column 16, line 20, claim 1, “binding means” should read --binding driving means--.

Column 16, line 67, claim 9, delete “(805)”.

Column 17, line 11, claim 11, “extractin the s natures” should read --extracting the signatures--.

Column 18, line 18, claim 20, “driving binding” should read --driving a binding--.

Column 18, line 26, claim 20, “folded,folding” should read --folded, folding--.

Column 18, line 47, claim 21, “of signatures” should read --of signatures;--.

Column 18, line 66, claim 21, “binding the binding” should read --binding in the binding--.

Column 20, line 31, claim 32, “machinecomprising” should read --machine comprising--.

Signed and Sealed this
Twentieth Day of October, 2015

Michelle K. Lee

Michelle K. Lee
*Director of the United States Patent and Trademark Office*